US006141676A

United States Patent [19]

Ramirez-Angulo et al.

[11] Patent Number: 6,141,676

[45] Date of Patent: Oct. 31, 2000

[54] DIGITALLY-CONFIGURABLE ANALOG VLSI CHIP AND METHOD FOR REAL-TIME SOLUTION OF PARTIAL DIFFERENTIAL EQUATIONS

[75] Inventors: Jaime Ramirez-Angulo; Mark R. DeYong, both of Las Cruces, N. Mex.

[73] Assignee: New Mexico State University Technology Transfer Corporation, N. Mex.

[21] Appl. No.: 09/120,986

[22] Filed: Jul. 22, 1998

Related U.S. Application Data

[63] Continuation of application No. 07/927,215, Aug. 10, 1992, abandoned.

[51] Int. Cl.[7] ..... G06G 7/38; G06G 7/32; G06J 1/00

[52] U.S. Cl. ..... 708/804; 708/802; 708/602

[58] Field of Search ..... 708/3, 6, 443, 708/801–802, 804

[56] References Cited

U.S. PATENT DOCUMENTS

| | | |
|---|---|---|
| 3,953,721 | 4/1976 | Johnson et al. . |
| 4,734,879 | 3/1988 | Lin et al. . |
| 4,817,027 | 3/1989 | Plum et al. . |
| 5,045,713 | 9/1991 | Shima . |
| 5,068,662 | 11/1991 | Guddanti et al. . |
| 5,107,442 | 4/1992 | Weideman . |
| 5,121,467 | 6/1992 | Skeirik . |
| 5,140,538 | 8/1992 | Bass et al. . |
| 5,140,670 | 8/1992 | Chua et al. . |

OTHER PUBLICATIONS

J. Ramirez–Angulo, et al., "CMOS Cells for Analog VLSI LaPlace Equation Solver Based on the Resistive Analogy Method", *Proceedings IEEE Midwest Symposium on Circuits and Systems* (1992).

H. Korayashi, et al., "An Active Resistor Network for Gaussian Filtering of Images", *IEEE Journal of Solid–State Circuits*, vol. 26, No. 5, pp. 738–748 (1991).

E. Sanchez–Sinencio, et al., Operational Transconductance Amplifier (OTA)–Based Nonlinear Function Systheses, *IEE Journal of Solid State Circuits*, vol. 24, No. 6, pp. 1576–1586 (1989).

Tamas Roska, et al., "Cellular Neural Networks with Nonlinear and Delay–Type Template Elements", proceedings IEEE International Workshop on Cellular Neural Networks and Their Applications CNNA–90 pp. 12–25 (1990).

U. Ramacher, "The VLSI Kernel of Neural Algorithms", proceedings IEEE International Workshop on Cellular Neural Networks and Their Applications CNNA–90. pp. 185–196 (1990).

(List continued on next page.)

*Primary Examiner*—Tan V. Mai
*Attorney, Agent, or Firm*—Jeffrey D. Myers

[57] ABSTRACT

A programmable Very Large Scale Integration (VLSI) chip and method for the analog solution of a family of partial differential equations commonly encountered in engineering and scientific computing: The Laplace equation, the diffusion or conduction equation, the wave equation, the Poission equation, the modified diffusion equation, the modified wave equation, and the wave equation with damping.

24 Claims, 19 Drawing Sheets

OTHER PUBLICATIONS

R. Tomovic, et al., "High Speed Analog Computers", published by John Wiley 7 Sons, New York (1962), Textbook.
W.J. Karplus, it al., "Analog Methods" published by McGraw–Hill New York (1959) Textbook.
W.J. Karplus, it al., "Analog Simulation, Solution of field Problems" published by McGraw–Hill New York (1958) Textbook.
A.S. Sedra, et al., "Filter Theory and Design: Active and Passive", Chapter 6, published by Matrix Publishers, Beaverton, Oregon (1978) Textboook.
R.L. Geiger, et al., "VLSI Design Techniques for Analog and Digital Circuits". published by McGraw–Hill, New York (1990) Testbook.
G. Liebmann, et al., "Solution of Partial Differential Equations with Resistance Network Analogue", *British Journal of Applied Physics*, vol. 1, No. 4, pp. 92–103 (1950).
G. Liebmann, et al., "Electrical Analogues", *British Journal of Applied Physics*, vol.. 4, pp. 193–200 (1953).
W.J. Karplus, et al., "The Use of Analog Computers with resistance Network Analogues", *British Journal of Applied Physics*, vol.. 6, pp. 356–357 (1955).
M.P. Kennedy, et al., "Neural Networks of Nonlinear Programming", *IEEE Transactions on Circuits and Systems*, vol. 35, No. 5, pp. 554–562 (1988).
A. Rodriguez–Vazques, et al., "Non linear Switched Capacitor 'Neural' Networks for Optimization Problems", *IEEE Transactions on Circuits and Systems*, vol. 37, No. 3, pp. 384–398 (1988).
L.O. Chua, et al., "Cellular Neural networks: Theory", *IEEE Transactions on Circuits and Systems*, vol. 35, No. 10, pp. 1257–1272 (1988).
K.R. Kreig, et al., "Analog Signal Processing Using Cellular Neural Networks", *IEEE ISCAS*, pp. 958–961 (1990).
L. Yang, et al., "VLSI Implementation of Cellular Neural Networks", *IEEE ISCAS*, pp. 2425–2427 (1990).
L.O. Chua, et al., "Cellular Neural networks: Applications", *IEEE Transactions on Circuits and Systems*, vol. 35, No. 10, p. 1273–1290 (1988).

30
L
L
L
L
C

1/s
32
C
C
C
C
L s
34
R
R
R
R
FDNR

DIGITALLY-CONFIGURABLE ANALOG VLSI CHIP AND METHOD FOR REAL-TIME SOLUTION OF PARTIAL DIFFERENTIAL EQUATIONS

This application is a continuation application of U.S. patent application Ser. No. 07/927,215, entitled "Digitally-Configurable Analog VLSI Chip and Method for Real-Time Solution of Partial Differential Equations", to Jaime Ramirez-Angulo and Mark R. DeYong, filed on Aug. 10, 1992, and the specification thereof is incorporated herein by reference now abandoned.

GOVERNMENT RIGHTS

The U.S. Government has a paid-up license in this invention and the right in limited circumstances to require the patent owner to license others on reasonable terms.

BACKGROUND OF THE INVENTION

The present invention relates to a VLSI microchip and method for real-time solution of seven types of partial differential equation encountered in most engineering and scientific applications. In particular, the present invention relates to the real-time solution of the following partial differential equations: Laplace equation, diffusion equation, wave equation, Poisson equation, modified diffusion equation, modified wave equation, and wave equation with damping.

Most engineering and scientific computing problems involve the solution of differential equations. In order to treat these problems by employing only the simple arithmetical operations available in digital systems, it is necessary to discretize the problem by numerical techniques. Typically, differential equation solutions are obtained by iteratively solving finite difference or finite element equations (the discrete counterpart to the continuous field equations). In the process, one of the prime advantages of digital computers is lost. So many individual operations are required in order to solve such problems, particularly field problems, that even though each individual step may take only a fraction of a microsecond, the complete solution may require many minutes or even hours. On an analog computer, however, the solution of a field problem becomes available almost immediately upon applying the desired boundary and initial conditions. An additional advantage of the analog computer is that a system capable of solving large problems may be implemented on a single VLSI chip or small set of chips, providing compact low-power components.

The field of analog computation attracted much attention in the fifties:

- R. Tomovic and W. J. Karplus, *High Speed Analog Computers*. New York: John Wiley & Sons, 1962.
- W. J. Karplus and W. W. Soroka, *Analog Methods*. New York: McGraw-Hill, 1959.
- W. J. Karplus, *Analog Simulation, Solution of Field Problems*. New York: McGraw-Hill, 1958.
- G. Liebmann et al., "Solution of partial differential equations with resistance network analogue," British Journal of Applied Physics, vol. 1, no. 4, pp. 92–103, 1950.
- G. Liebmann et al., "Electrical analogues," British Journal of Applied Physics, vol. 4, pp. 193–200, 1953.
- W. J. Karplus et al., "The use of analog computers with resistance network analogues," British Journal of Applied Physics, vol. 6, pp. 356–357, 1955.

Although the basic concept was theoretically well proven at this time, it was of little practical use because of the many limitations of the implementations available in this pre-VLSI era. In spite of this, and the subsequent prevalent dominance of digital computers employing VLSI chips, analog computation has continued to be recognized as the ideal solution for applications where real-time processing is required.

The current status of analog VLSI technology makes it feasible to develop full-scale analog processing systems to aid conventional digital computers. Such analogy processors will provide assistance to conventional digital systems in problem areas well suited to analog solution, such as the solution of partial differential equations. These equations arise in most areas of engineering and scientific computing: gravitational, electrostatic, magnetic, thermal, stress, fluid flow field analysis, wave propagation, and image processing.

The present invention is a high-performance programmable VLSI chip for the analog solution of a family of partial differential equations commonly encountered in engineering and scientific computing. The present invention provides for the real-time solution of large linear and nonlinear partial differential equations and is fully compatible with existing digital systems. The present invention directly reduces the time and cost of solving differential equations by several orders of magnitude.

The present invention is also of a special purpose analog computer which is digitally reconfigurable. It has, in a very broad sense, a neural-like structure consisting of a large number of simple computational elements that are highly interconnected. For this reason it shares the characteristics of neural network systems: robustness and fault tolerance. Progress has been reported recently in the implementation of other types of analog computing systems using neural-like structures: 1) for the solution of nonlinear quadratic optimization problems; M. P. Kennedy and L. O. Chua, "Neural networks for nonlinear programming," IEEE Transactions on Circuits and Systems, vol. 35, no. 5, pp. 554–562, 1988; A. Rodriguez-Vazquez, R. Dominguez-Castro, A. Rueda, J. L. Huertas, and E. Sanchez-Sinencio, "Nonlinear switched capacitor neural networks for optimization problems," IEEE Transactions on Circuits and Systems, vol. 37, no. 3, pp. 384–398, 1988 and 2) for image processing applications using cellular neural networks; L. O. Chua and L. Yang, "Cellular neural networks: theory." IEEE Transactions on Circuits and Systems, vol. 35, no. 10. pp. 1257–1272, 1988; L. O. Chua and L. Yang, "Cellular neural networks: applications," IEEE Transactions on Circuits and Systems, vol. 35, no. 10, pp. 1273–1290, 1988; T. Matsumoto, L. O. Chua, and H. Suzuki, "Analog signal processing using cellular neural networks," Proc. IEEE ISCAS, pp. 958–961, New Orleans, La., 1990; L. Yang, L. O. Chua, and K. R. Krieg, "VLSI implementation of cellular neural networks," Proc. IEEE ISCAS, pp. 2425–2427, New Orleans, La., 1990. In spite of the fact that the solution of partial differential equations using analog computation techniques was an active area of research in the fifties, no systems have been implemented in analog VLSI circuitry for the solution of these type of equations.

The Laplace Equation $$\nabla^2\phi=0 \tag{1}$$

is the most important and most commonly found fundamental equation of applied physics. It is useful in describing static and/or steady-state conditions in virtually all major areas of physics. Any field composed entirely of just one element type can be described by the Laplace equation (LE).

One refers to three basic types of elements in a system: dissipative elements, potential energy storing elements and kinetic energy storing elements (in electric networks, these correspond to resistances, capacitors, and inductors, respectively). In all other areas of engineering there are elements that have similar functions, e.g. in mechanics the dissipative, potential energy storing, and kinetic energy storing elements correspond to dashpots, springs, and masses. Systems in which excitations are constant or enough time has elapsed since a previous change in the excitation took place are described by the LE. Systems containing only one of three basic types of elements occur in almost any physical area. Gravitational, electrostatic, and magnetic fields can be analyzed using the LE. Certain fluid-flow systems can also be analyzed using the LE, e.g. incompressible fluids flowing through mediums with very small pore channels are purely dissipative and can be modeled as resistive networks, and incompressible fluids flowing through open channels can be modeled as inductive networks. In mechanics, static deflection of elastic membranes having negligible masses can be modeled as capacitive networks. The irrotational steady-state of compressible or viscous liquids can be analyzed by means of the LE, as can temperature distribution in thermal systems in which static or steady-state conditions have been reached (not with time dependent excitations) and in which all energy reservoir elements have acquired all the energy they can store. Purely inductive 10 and capacitive 12 networks are modeled electronically using the same basic cell 14 shown in FIG. 1.

The transformation of a capacitive or an inductive network into a resistive network can be done using well known impedance transformations used in filter theory. A. S. Sedra and P. O. Bracket, *Filter Theory and Design: Active and Passive*, ch. 6 (Beaverton, Oreg.: Matrix Publishers, 1978). This takes place by scaling all elements in the network by the same factor. For example, by scaling all elements in a capacitive network by the s factor (complex frequency variable) they are transformed into equivalent resistances ($R_{eq}$=1/C); the nodal voltages (and therefore the field solution they represent) are not affected by this operation. An inductive network scaled by 1/s is also transformed into a resistive network ($R_{eq}$=L) without affecting the field solution. In the present invention resistors are simulated electronically by means of MOS transistors operating in non-saturated mode as described by R. L. Geiger, P. E. Allen, and N. R. Strader, *VLSI Design Techniques for Analog and Digital Circuits*, (New York: McGraw-Hill, 1990); J. Ramirez-Angulo, M. DeYong, S. Ming-Sheng, "CMOS cells for analog VLSI Laplace equation solver based on the resistive analogy method," Proc. IEEE Midwest Symposium on Circuits and Systems, in press, Washington, D.C., 1992. Analog VLSI electrical implementations of resistive networks have been used successfully for image processing, which is another area in which the LE frequently arises: H. Kobayashi, J. L. White, and A. A. Abidi, "An active resistor network for Gaussian filtering of images," IEEE Journal of Solid-State Circuits, vol. 26, no. 5, pp. 738–748, 1991.

The Diffusion or Conduction Equation $$\nabla^2 \phi = k \frac{\partial \phi}{\partial t} \tag{2}$$

ranks with the LE as another important and fundamental equation of applied physics. Systems containing dissipative elements and one type of (kinetic or potential) energy storage element are described by the diffusion equation (DE). In these types of systems the field is dependent on time—now an additional variable—and the systems are characterized by solutions which approach their final value monotonically without overshoot. The LE may be considered a special case of the DE where sufficient time has elapsed since any previous change in the excitations, which causes the time dependent term of (2) to become zero.

The DE finds frequent application in heat-transfer problems where the systems under study consist of energy storage (capacitive) and dissipative elements; temperature and heat flux correspond to voltage and current in electric circuits. The DE describes the diffusion of any type of fluid particles in a space occupied by a different fluid. Concentration ($\rho$) and flux ($\psi$) of particles correspond in this case to V and I in electric circuits. Problems of irrotational incompressible fluid flow in which viscous (dissipative) and compressional forces (potential energy storage) occur, the DE is used to predict velocity potential or pressure at points within the flow stream. Skin effects in electromagnetics relate current density J along a conductor to its magnetic permeability ($\mu$) and its electric conductivity ($\sigma$). In general electromagnetics, Maxwell's equations reduce to the DE in fields that have conductivity but in which either the permeability or the dielectric constant can be neglected. Mechanical systems consisting of dashpot-type damping elements and either appreciable masses or spring-forces can be modeled using the DE. An example is the deflection of a string or a drumhead of negligible mass. Optics and soil compaction are other areas where the DE is fundamental.

In all cases, systems governed by the DE in two dimensions are modeled electronically by a grid of cells 20 and 22 as shown in FIG. 2*a* and FIG. 2*b*. Using the appropriate impedance transformations, the cell 22 of FIG. 2*b* is transformed into the cell 20 of FIG. 2*a* without changing the numerical value of the field solution. Parallel plate capacitors can be implemented in any double metal or double poly CMOS VLSI technology.

The Wave Equation $$\nabla^2 \phi = k \frac{\partial^2 \phi}{\partial t^2} \tag{3}$$

is the third fundamental equation of physics and describes the phenomenon of wave motion. Fields governed by the wave equation (WE) possess distributed inductances and capacitances (or the equivalent elements in other systems) and are modeled by cells 30 and 32 like the ones shown in FIG. 3*b* and FIG. 3*c* using transconductors, which can be replaced by MOS transistors in saturated mode. Scaling the network 32 in FIG. 3*c* by the factor s transforms the capacitors into resistors and the inductor into a "super-inductor" or frequency dependent negative resistance (FDNR1, characterized by an impedance $Z=s^2K$), as in the circuit 34 of FIG. 3*a*. Scaling the network 30 of FIG. 3*b* by the factor 1/s transforms the inductors into resistors and the capacitor into a "super-capacitor" or FDNR2 (characterized by an impedance $Z=1/s^2D$), as in the circuit 34 of FIG. 3*a*. Resistors are implemented electronically using MOS transistors in the non-saturated mode while "super-inductor" FDNRs use can be implemented using two capacitances and six MOS transistors operating in saturated mode. The "super-inductor" and "super-capacitor" both behave as FDNRs, but the former has a less complex CMOS VLSI implementation.

The WE is applicable to systems comprised of both types of energy storage elements with negligible dissipative characteristics. In dynamics pure wave motion occurs if appreciable spring-forces and inertial mass forces are present and only if viscous damping can be neglected. An example is the vibration of a drumhead with negligible damping. Vibrating strings may likewise exhibit these properties.

The Modified Equation Forms

The systems discussed above correspond to systems without internal excitations, where energy is supplied at the boundary. In various physical systems internal energy sources arise and the equations as well as grid elements representing these equations have to be modified to take these excitations into account. The excitations can be represented by means of current sources at each grid element as shown in FIG. 4 and in general they correspond to a transformation between different types of energy. For example, they might represent currents induced in a grid array of phototransitors by the incidence of light on their base regions. H. Kobayashi, J. L. White, and A. A. Abidi, "An active resistor network for Gaussian filtering of images," IEEE Journal of Solid-State Circuits, vol. 26, no. 5, pp. 738–748, 1991. The current sources are easily implemented electronically using MOS transistors in saturated mode. The inclusion of internal energy sources transforms the LE into the Poisson equation (PE):

$$\nabla^2\phi=-\mathrm{ki}i \tag{4}$$

In a system governed by (4), in addition to the boundary conditions the internal source distribution i(x, y) must be specified. The PE finds a great deal of application in heat transfer systems in such areas as the analysis of thermal fields of nuclear reactors and dynamic systems in which viscous damping converts some of the mechanical energy into thermal energy. In electrostatics the presence of uniformly distributed charge throughout the field gives rise to the same equation.

The presence of distributed-energy sources in systems containing more than one type of element leads to equally simple modifications of the DE and WE (5) and (6), respectively:

$$\nabla^2\phi = k_1\frac{\partial\phi}{\partial t} - k_2 i_i \tag{5}$$

$$\nabla^2\phi = k_1\frac{\partial^2\phi}{\partial t^2} - k_2 i_i \tag{6}$$

Equivalent circuit representations of the cells 14, 20, and 34 of FIG. 1, FIG. 2, and FIG. 3 are modified by including a current source i(x, y) injected to the cells 40, 42, and 44 node, as illustrated in FIG. 4. Internal energy sources can be time and position dependent and may also be a nonlinear function $f(\phi)$ of the potential existing at each point. For example, in a space charge limited vacuum tube the charge distribution is determined by the square root of the potential. The PE for this general case becomes:

$$\nabla^2\phi=k_1 i_i-k_2 f(\phi) \tag{7}$$

The DE and LE are modified accordingly to include additional terms $-k_3 f(\phi)$. Electrical modeling of the function $k_3 f(\phi)$ specific for each system can be done using nonlinear approximation techniques similar to those reported in E. Sanchez-Sinencio, J. Ramirez-Angulo, and B. Linares-Barranco, "OTA-based Nonlinear functions Synthesis," IEEE Journal of Solid State Circuits, vol. 24, no. 6, pp. 1576–1586, 1989.

Wave Equation with Damping

Many systems contain both types of energy-storage elements as well as dissipative elements. For their solution using analog VLSI circuits they can be represented by a grid of cells 50 like those shown in FIG. 5*b*. The cells can be impedance scaled by the factor 1/s to include floating resistors and capacitors and a grounded FDNR2 and a grounded capacitor as in the circuit 52 shown in FIG. 5*a*.

The electronic implementation of this cell uses MOS transistors in ohmic mode to simulate the floating resistors and poly-poly capacitors to implement both floating and grounded capacitors (care must be taken in connecting the bottom plate of the floating capacitors to the central cell-node so that the large bottom plate parasitic capacitance of the poly-poly capacitor is absorbed by the grounded capacitor and it does not introduce new elements into the cell). The wave equation, in this case called the damped wave equation, takes the form:

$$\nabla^2\phi = k_1\frac{\partial^2\phi}{\partial t^2} + k_2\frac{\partial\phi}{\partial t} + k_3\phi \tag{8}$$

Its modification to include distributed energy sources is done in a way similar to that explained before.

The response of a system described by (8) to a step-function excitation at a boundary is not monotonic as in the case of the DE, but may involve overshooting and oscillating about the equilibrium value since the eigen modes (poles) of the system are complex. The electronic implementation using transistors in saturated mode requires careful consideration of stability conditions since the gain available from active elements and the cell interconnections might result in positive feedback loops with a gain higher than one at some frequencies. Potentials and/or potential-gradients at every boundary must be specified, as well as kinetic and potential energy stored within the field at the initial instant.

The damped WE finds application in all the physical systems in which the three types of elements are present. Motion of points within systems containing appreciable mass, spring forces, and viscous damping is described by the damped WE. It also applies to the study of vibrating strings or elastic sheets, fluid-dynamic systems where the fluids are compressible and both viscous and inertial forces are present, and electromagnetic field problems for systems containing appreciable permeability, dielectric properties, and conductivity.

SUMMARY OF THE INVENTION

The present invention is of an. apparatus and a method for solving equations, comprising: providing a multi-dimensional array of digitally configurable cells to an analog integrated circuit board; and digitally configuring a resistance of each of the cells. In the preferred embodiment, the equations are solved in real-time and are partial differential equations of the following types: the Laplace equation, the diffusion equation, the wave equation, the Poisson equation, the modified diffusion equation, the modified wave equation, and the wave equation with damping. The invention also provides for solution of non-linear partial differential equations. The cells are implemented in CMOS VLSI and are configurable by digital computer. The cell potentials are detected and sent for processing by a digital computer. The cells are substantially identical to one another and are preferably arrayed in two dimensions (at least 128 by 128) and provided to a single VLSI chip.

The invention is also of an integrated circuit board and a method for solving partial differential equations, comprising: a) providing an array of digitally configurable analog integrated circuit cells to an integrated circuit board; b) interfacing the circuit board to a data bus of a digital computer; c) receiving digital configuration instructions from the data bus; and d) providing potentials of the cells to the data bus.

A primary object of the invention is to provide for real-time solution of partial differential equations commonly needed in the sciences.

Another object of the invention is to provide a circuit board for solving such equations having a standard interface with scientific personal computers and computer workstations.

A primary advantage of the invention is that it reduces the time and cost of solving differential equations by several orders of magnitude over prior art analog devices and over prior art digital computation devices.

Another advantage of the invention is that it is robust and fault tolerant because it has a neural-like structure.

An additional advantage of the invention is that it can easily be incorporated into a host digital computer to provide digital computer software with the ability to call analog routines for solution of appropriate equations.

DESCRIPTION OF THE PREFERRED EMBODIMENTS

The present invention is an analog integrated circuit and a method for the real-time solution of partial differential equations. The present invention is composed of a two-dimensional array of basic cells. The basic cells are CMOS VLSI circuits, which can be electronically configured into any of the seven two-dimensional electronic models discussed in the background section (14, 20, 34, 40, 42, 44, and 52). A host digital computer will provide control and data storage for the array. The host computer will run a program that graphically displays the system configuration and corresponding cell potentials for data interpretation. The program controls the prototype operation and data management by down-loading configuration and bias data to the chip and up-loading output data for storage and analysis. The basic cell is designed to allow for large scale arrays to be formed on a single VLSI chip (128×128 cell array on a 2 cm×2 cm VLSI die). The VLSI chip can be integrated into a board level system which would be compatible with conventional digital computers (e.g. work stations, personal computers, Macintosh computers, and other computer systems). This extension is described in Example 3.

Figure 6B:
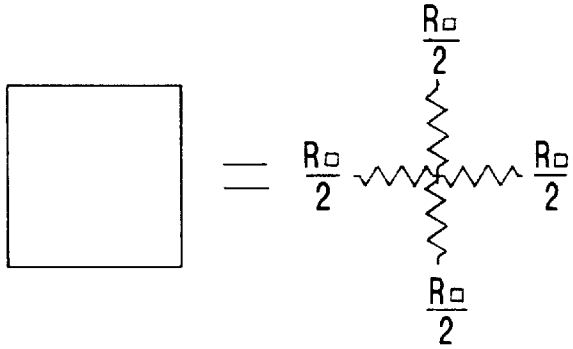
FIG. 6 is a schematic of prior art derivation of an equivalent circuit for a film resistor. a) film resistor with aspect ratio 3:2 divided into six cells, b) equivalent circuit for cell, c) circuit representation of film resistor with 24 resistors, and simplified circuit.
Figure 6A:
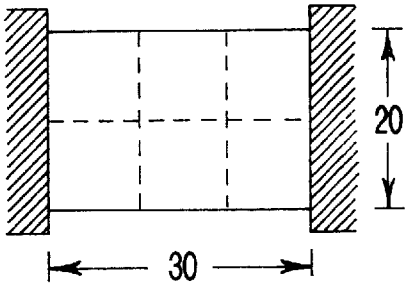
Figure 6C:
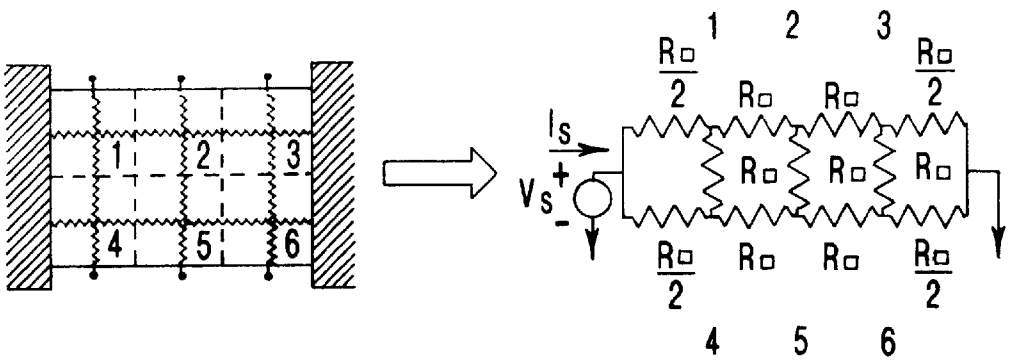

The approach taken in the present invention is based on the finite difference method and its equivalent circuit implementation using the resistive analogy method. For this, the two dimensional space is subdivided into a discrete grid of cells (see FIG. 6*a*). Each cell is replaced by an equivalent circuit consisting of four resistors connected between a common node and each of the four neighboring cells (FIG. 6*b*). This approach leads to an equivalent circuit with a very large number of resistors (FIG. 6*c*). The potential at the node of each cell represents approximately the electrostatic potential at the location of the cell. This method allows for the definition and solution of two dimensional electrostatic field problems with arbitrary (and position dependent) resistivity and arbitrary boundary conditions within the resolution allowed by the grid. To implement the resistors of the basic cell of FIG. 6*b*, single MOS transistors in the triode mode of operation are employed.

Elements of Basic Cell

Figure 7A:
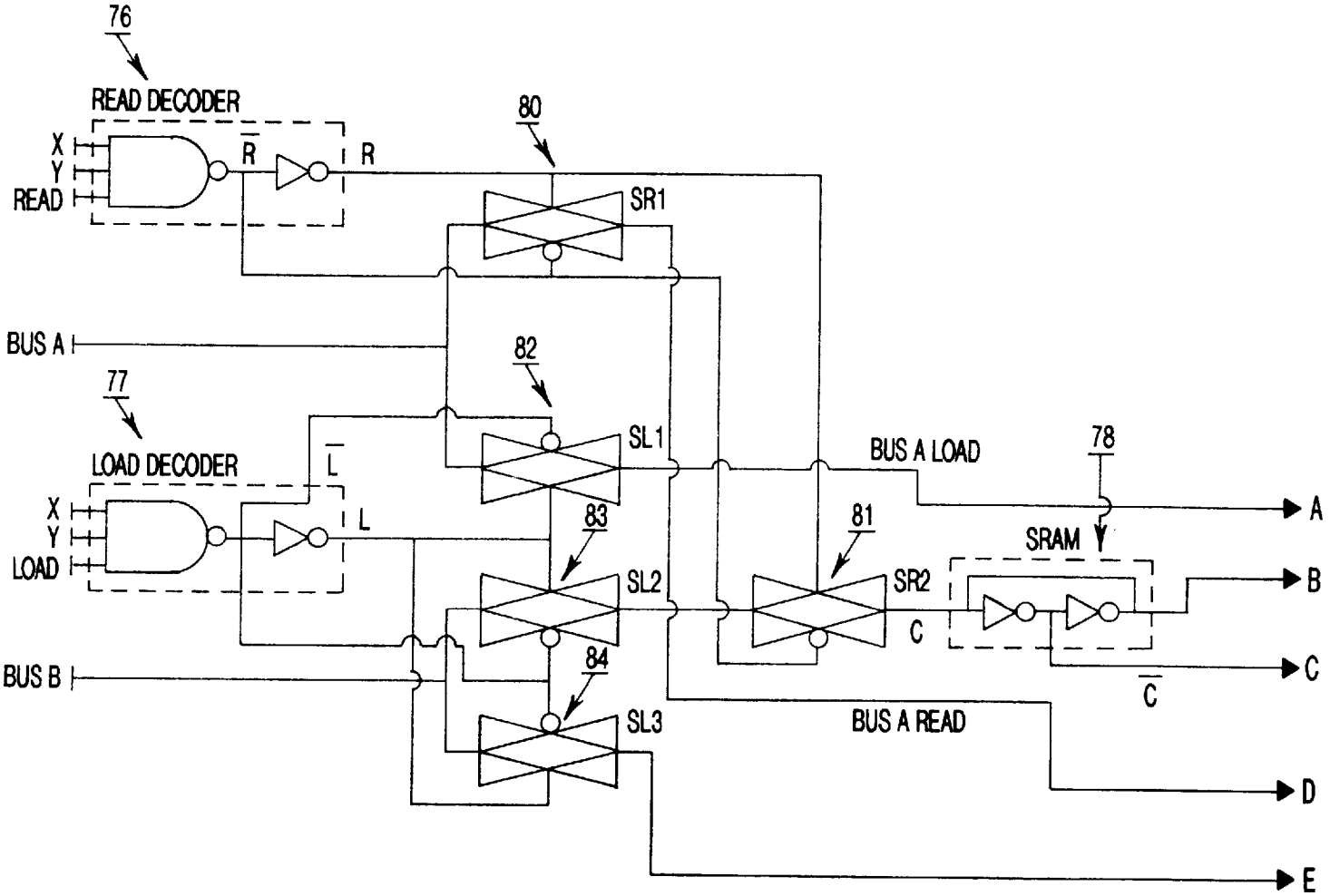
FIG. 7 is a schematic of the preferred elements of basic resistive cell for solution of the Laplace equation.
Figure 7B:
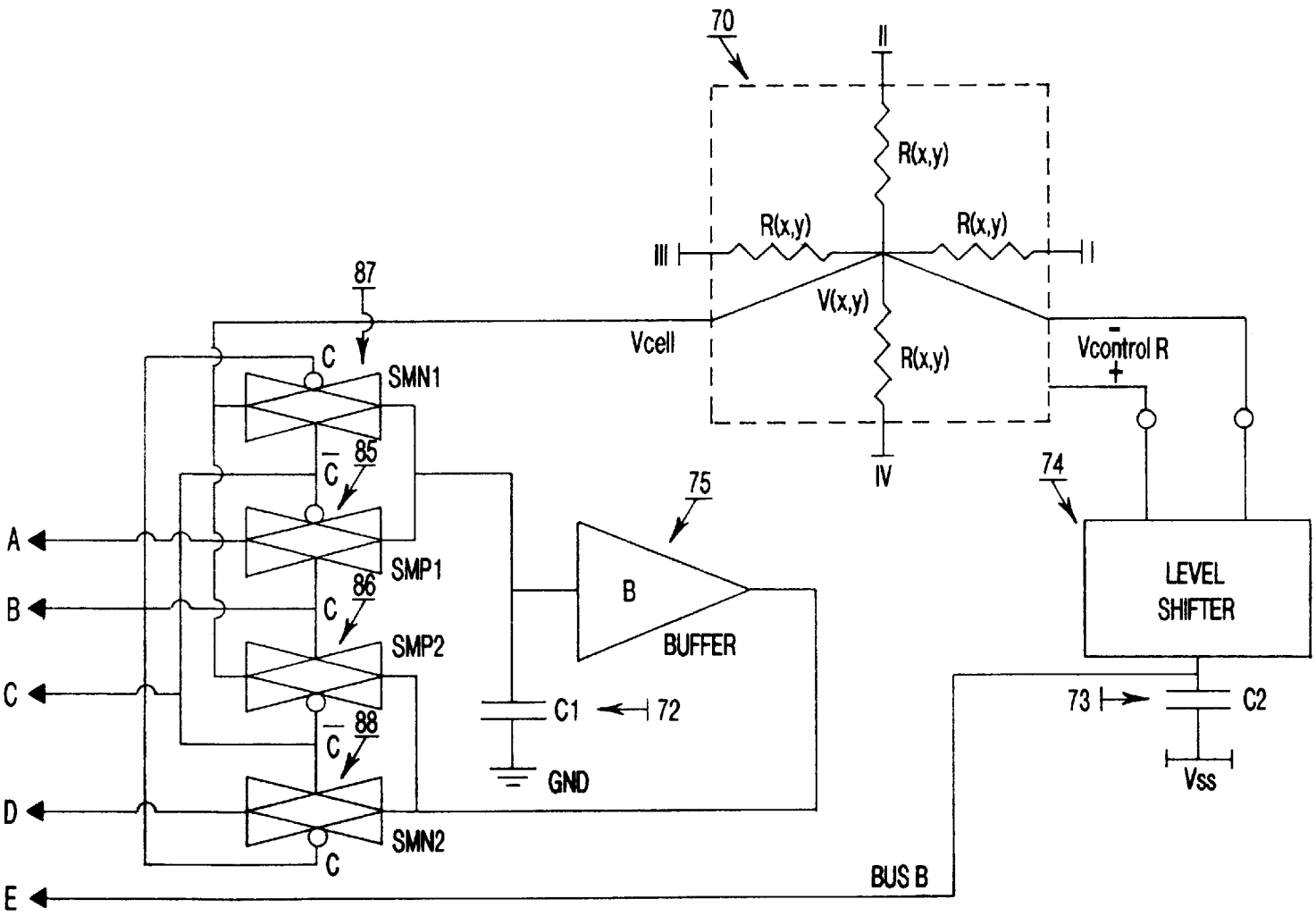
Figure 8A:
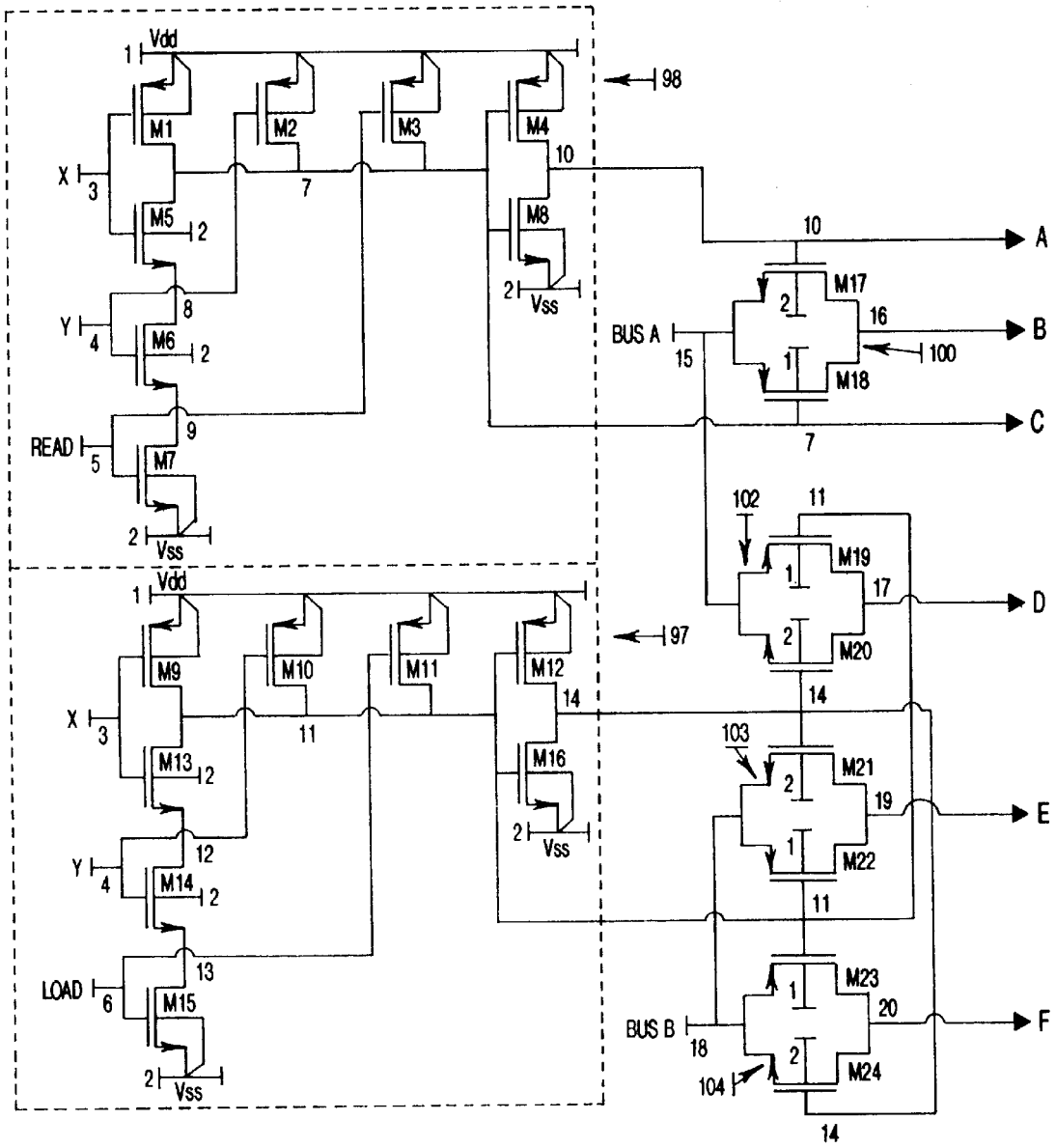
FIG. 8 is a schematic of the preferred transistor level implementation of basic resistive cell for solution of the Laplace equation.
Figure 8B:
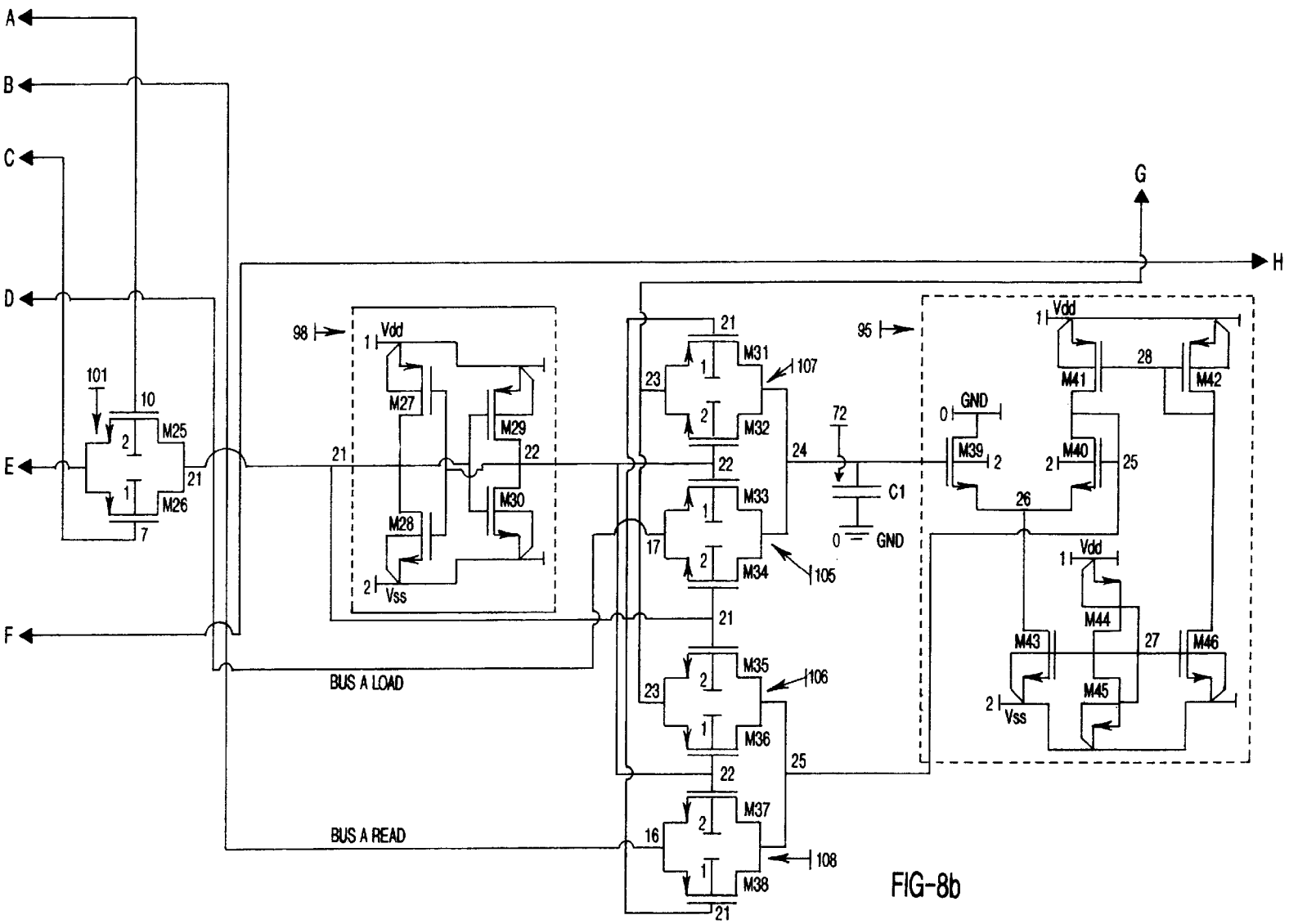
Figure 8C:
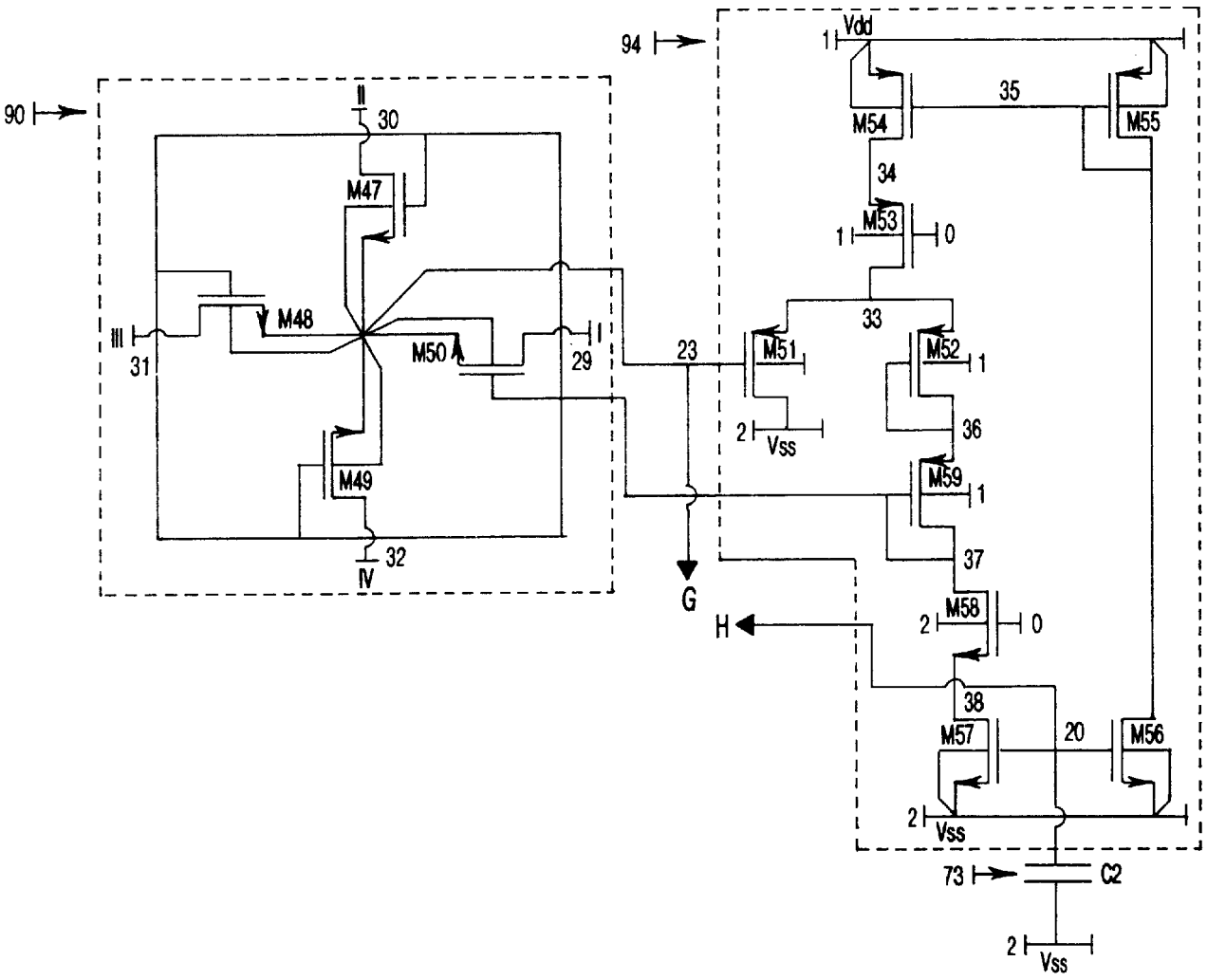

The elements of a basic cell for solution of the Laplace equation are shown in FIG. 7, and the actual transistor level implementation (in CMOS P-well technology) is shown in FIG. 8. The cell includes:

1. four transistors connected to a common node (the voltage at this node is referred in what follows as VCELL 70) in ohmic mode used to simulate the cell programmable resistors, 2. two small valued capacitors (C1 72 and C2 73), 3. a level shifter 74 which generates from the voltage stored in C2 a floating voltage that is applied to gate-source terminals of the transistors simulating resistors to control their equivalent resistance, 4. a buffer 75 that is used either to hold the fixed voltage boundary condition stored in C1 72 (connected to VCELL 70) or to hold the voltage at which the cell settles during the reading cycle (cycle 4), 5. two decoders 76 and 77, implemented with a three input NAND gate and a CMOS inverter for each. The decoders assert the internal read (load) line denoted R (L) when X, Y and the external READ (LOAD) line are at a logic high, 6. an SRAM 78 cell implemented with two CMOS inverters, 7. nine CMOS (complementary) switches that configure the cell and control flow of data between BUS A and BUS B and the elements in the cell. Two switches are controlled by the cell internal read line (SR1 80 and SR2 81 close when R is asserted), three are controlled by the internal load line (SL1–SL3 82, 83, and 84 close when the L is asserted), and four switches controlled by the SRAM stored value (SMP1 85 and SMP2 86 close and SMN1 87 and SMN2 88 open when C has a logic level 1).

Figure 9:
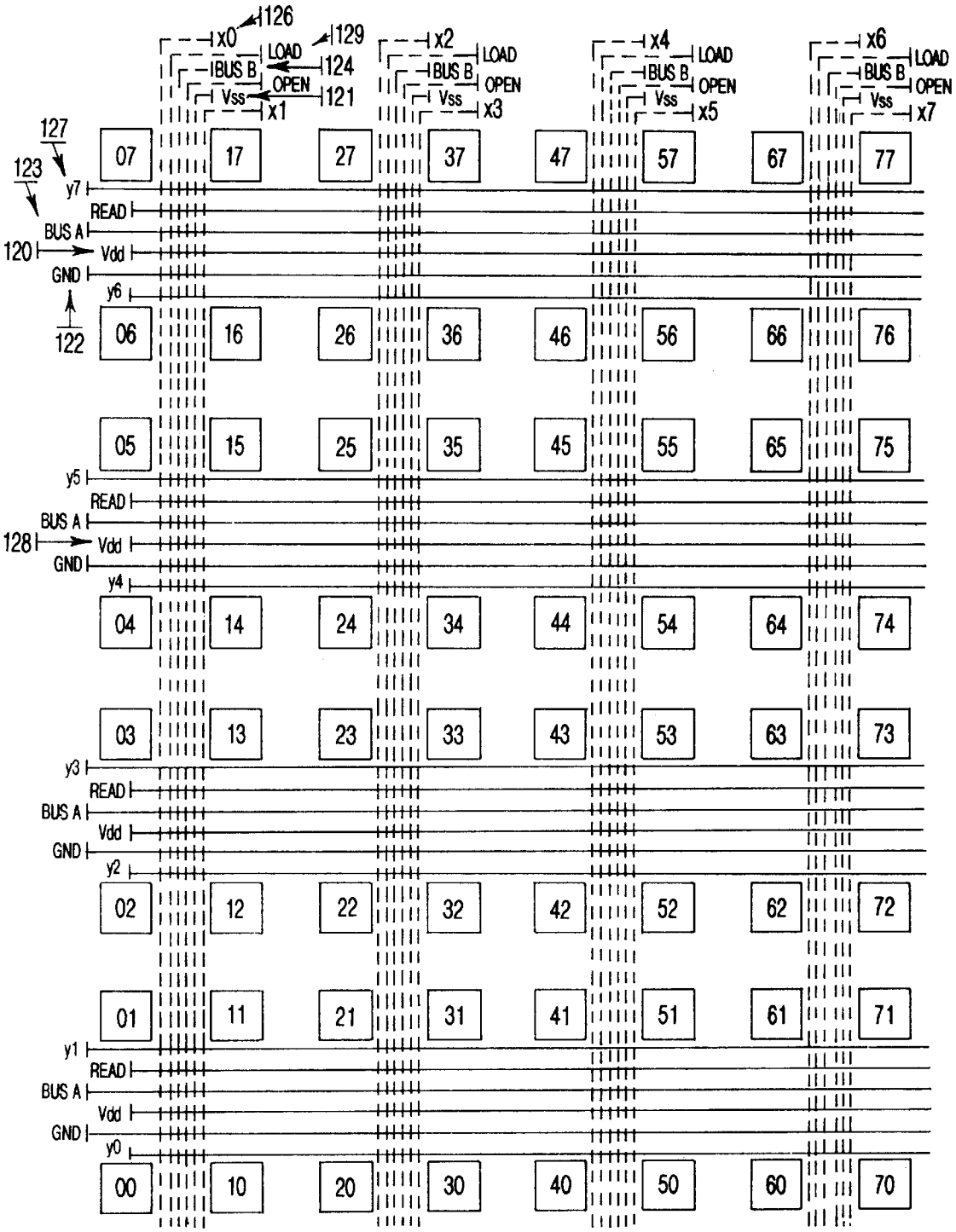
FIG. 9 is a schematic of a two-dimensional array of basic cells (8×8 cells).

Externally the cell is connected to a total 9 lines (see FIG. 9): positive and negative power supply lines (Vdd 120 and Vss 121), ground line 122, two buses, BUS A 123 and BUS B 124, lines X 126 and Y 127 to address the cell, and READ 128 and LOAD 129 control lines. BUS A 123 and BUS B 124 are used to transfer the digital configuration code to the SRAM 78, to transfer the (analog) value of the fixed voltage boundary condition, to transfer the (analog) value of control voltage to program the cell resistance and to read VCELL 70 after settling.

A detailed description of the operation of each of the elements in the cell follows:

Transistors Simulating Cell Resistors (M47–M50)

The four resistors of the basic cell 90 are implemented by the N-channel transistors M47–M50 which operate in ohmic mode and which are all in a common well. They have common gate connections (node 37) and common source and substrate connections (node 23 corresponds to VCELL 70). The drain substrate connection for these transistors avoids "body effect", so that all transistors in the cell (and in all cells in the two dimensional array) have approximately the same threshold voltage Vt=Vt0 (where Vt0 is the zero source-bulk threshold voltage) which allows all of the transistors (M47–M50) to have predictable equivalent resistances. For the implementation shown in FIG. 8, CMOS P-well technology is required in the case that M47–M50 are P-channel transistors; otherwise N-well CMOS technology is required. The potential at the common node 23 represents the field solution of the cell (denoted VCELL 70 previously). Nodes 29, 30, 31 and 32 connect transistors simulating resistors in the four neighboring cells (I, II, III, and IV). These nodes establish (analog) interaction with the four neighboring cells. The equivalent resistance for transistors in one cell (M47–M50) is the same and is determined by the control voltage applied between nodes 37 and 23 which is the gate-source voltage for M47–M50. This voltage difference is determined by the voltage stored in cycle 3 in capacitor C2 73.

The voltage in C2 73 (denoted Vc2 in what follows) is used:

a. For cells configured as resistive cells, to adjust the equivalent resistance of the cell to the desired value Req according to the expression for the equivalent resistance of an MOS transistor operating in ohmic mode: Req=(KP*W/L(VGS−VTH))−1, where KP is the transconductance parameter, W/L the width over length ratio, VTH the threshold voltage and VGS=V23–V37 the gate-source voltage of the MOS transistors M47–M50 provided by the level shifter;

b. For cells configured as empty boundary cells by setting Vc2=Vss which turns off M47–M50 so that these transistors behave as open circuits; and c. To configure the cell as a fixed voltage boundary cell in which case Vc2 is set to Vdd resulting in the minimum possible equivalent resistance Reqmin. In practice, even if this resistance is not zero (as required ideally for a fixed voltage boundary cell), the error that this will cause in the field solution can be compensated for by adjusting accordingly the resistance of the neighboring cells.

Level Shifter

Transistors M51–M59 implement a level shifter 94 that allows establishment of the required floating control voltage between the gate and source of the transistors simulating resistors. This voltage is determined by the voltage in capacitor C2 73 (denoted Vc2). The circuit operates as follows: M57–M58 and M53–M54 implement cascode DC current sources with values Icontrol and Icontrol/2 respectively. M54–M55 and M56–57 form current mirrors. The arrangement shown and the sizing of the transistors causes constant and equal currents Icont/2 to flow through the matched transistor pair M51–M52. The resistance control voltage (denoted VcontrolR) appearing between nodes 23 and 37 depends only on the current Icontrol and is the sum of the gate-source voltages of the (diode connected) transistors M52 and M59. Since Icontrol is determined by Vc2, then VcontrolR is also determined by Vc2.

Buffer

Transistors M39–M36 implement a buffer 95 which is used to sense the voltage at capacitor C1 72 (node 24) without discharging it and provides a replica of this voltage at node 25 which can be loaded. Operation of this circuit is as follows: M44–M45 form an active voltage divider from which the buffer bias voltage (voltage at node 27) is produced. This voltage is used to establish DC bias currents Ibuff in M43 and Ibuff/2 in M45, M42, and M41. Transistors M42 and M41 form a unity gain current mirror, while transistors M43, M46 are ratioed so that the current in M43 is twice as large as the current in M46. Transistors M39 and M40 are matched and have their substrate connected to the negative supply Vss. Body effect causes their threshold voltages to be relatively large. Due to their equal sizing and equal drain currents M39 and M40 have the same gate-source voltage which causes the voltage at node 25 to follow the capacitor voltage Vc1 (node 24). The drain terminal of M39 is connected to ground to maintain the drain-source voltages of M39 and M40 as equal as possible, thereby minimizing errors (offsets) in the voltage follower operation due to channel length modulation. This has a disadvantage in that the maximum voltage at node 24 has to be kept below the threshold voltage of M39 and M40 in order to keep them in saturated mode. Since their threshold voltages are relatively large, the voltage range for Vc1 is also relatively large. An additional advantage of the connection of the substrate of M39 and M40 to Vss instead of placing these transistors within a separate well is silicon area savings. The well for all N-channel transistors in the chip is common and connected to Vss with exception of the four transistors simulating resistors which require a separate well in each cell.

Static RAM (SRAM)

Transistors M27–M30 forms a conventional static RAM cell 98 that stores a digital code for the configuration of the cell as a resistive, empty boundary or fixed voltage boundary cell. These transistors form two CMOS inverters (M27, M28 and M29, M30) in a positive feedback configuration. The input and output nodes (node 21 and node 22) take complementary logic values. These voltages are used to control switches that interconnect the elements of the cell to configure it.

READ Decoder

Transistors M1 through M8 form a three input AND gate based decoder circuit 96 that sends a high logic level at node 10 (R node or internal read line) when all inputs labeled X, Y and READ are set to a high logic level. M4 and M8 constitute a CMOS inverter used to obtain the logic complement of the voltage at node 7, at node 10.

LOAD Decoder

Transistors M9 through M16 also form a three input AND gate based decoder circuit 97 that delivers a logic high value at node 14 (L node or internal load line), when all inputs labeled X, Y and LOAD axe set to a high logic level. M12 and M16 constitute a CMOS inverter used to obtain the logic complement of the voltage at node 11, at node 14.

Complementary Analog Switches for Configuring Cell

The following transistor pairs form complementary CMOS analog switches that interconnect elements of the cell (as explained in the next section):

Controlled by READ 128 line (nodes 7 and 10): switches SR1 (M17, M18) 100 and SR2 (M25, M26) 101 which are closed when X 126, Y 127 and READ 128 (nodes 3, 4 and 5 respectively) are set to a logic 1 (read is asserted).

Controlled by LOAD 129 line (nodes 11 and 14): SL1 (M19, M20) 102, SL2 (M21, M22) 103, and SL3 (M23, M24) 104 which are closed when X, Y and LOAD are set alike to a logic 1 (LOAD is asserted).

Controlled by SRAM 98 code (nodes 21 and 22): SM1N (M31, M32) 107, SM1P (M33, M34) 105, SM2P (M35, M36) 106, and SM2N (M37, M38) 108. SM1N and SM2N are closed when the SRAM has a zero stored and are open otherwise. SM1P and SM2P are closed when the SRAM has a logic high stored and are open otherwise.

Cycles of Operation of the System

The five cycles of operation of the system are as follows:

Cycle 1. POWER UP CYCLE: Vdd and Vss are energized.

Cycle 2. STORAGE OF CONFIGURATION CODE IN STATIC RAM: LOAD and READ lines are asserted (closing switches SR1, SR2, SL1, SL2 and SL3). This results in the connection of BUS B (node 18) to the input node of the SRAM cell (node 21) which stores a configuration code in node 21 and its complement in node 22. If a logic high is stored the cell will be configured as a fixed voltage boundary cell. If a logic low is stored, the cell will be configured either as a resistive or as an empty cell. The voltage in BUS A can take an arbitrary value during this cycle.

Cycle 3. CELL CONFIGURATION AND LOADING OF ANALOG DATA: control voltages for resistive cells and fixed voltage values for fixed voltage boundary cells are set. READ is deasserted and LOAD is still asserted (only switches SL1, SL2, and SL3 remain closed). The code stored in the SRAM together with the voltages in BUS A and BUS B allow configuration of the cell according to the following cases:

Fixed voltage boundary cell: RAM has a logic high stored (node 21 at 1 node 22 at 0) which causes closing of switches SM1P and SM2P. BUS A transfers the fixed voltage boundary value to capacitor C1 connected to the input of the buffer. The output of the buffer connects to the cell central node (node 23 or VCELL). This allows the fixed voltage boundary condition in C1 to be maintained without being discharged. BUS B transfers a value Vdd to capacitor C2 which causes the resistances of equivalent resistors to be minimized as required for the fixed voltage boundary cell.

Resistive cell: SRAM has a logic low stored which causes SMN1 and SMN2 to close. The buffer input node (node 24) is connected to VCELL (node 23) while the output of the buffer is left floating. BUS B transfers to C2 the analog control voltage to adjust equivalent resistance of the cell to the required value.

Empty cell: SRAM has a code 0 stored. Cell is configured as a resistive cell with the only difference that now BUS B transfers a control voltage Vss to C2 which causes all transistors simulating resistors to turn off.

Cycle 4. SETTLING OF VLSI ARRAY TO FIELD SOLUTION: LOAD is deasserted (SL1, SL2, SL3 open) which disconnects BUS A and BUS B from all cell nodes.

Cycle 5. READ CELL NODAL VOLTAGES: READ is asserted (SR1 and SR2 closed). This connects VCELL (node 23) to BUS A through the buffer. The buffer allows sensing of VCELL (voltage representing the field solution) without discharging the capacitor C1 that holds this voltage. This connection through the buffer is required since if VCELL is connected directly to BUS A charge redistribution between the relatively large capacitance of BUS B and C1 would cause a change in the sensed value of VCELL. The buffer also allows sensing of VCELL to be rapid.

Additional Remarks on the System Operation

The basic cell has a global high capacity driving buffer used to sense the voltage in BUS A during cycle 4 and to provide the voltage to the chip output voltage sensing pin. The global buffer is required to isolate BUS A from the chip voltage sensing pin. The buffer also allows delays in transferring the voltage in BUS A to the output pin reading operation during the reading cycle (cycle 5). The input of the buffer is connected to BUS A and its output to the pin sensing voltage by means of two (global) transmission gates.

Extension of the Basic Resistive Cell for Solving Other Types of Partial Differential Equations The basic cell is useful in solving the Laplace equation. With minor modifications to the basic cell a system with the same basic architecture as the one described above can be used to solve many types of commonly found partial differential equations.

Figure 10C:
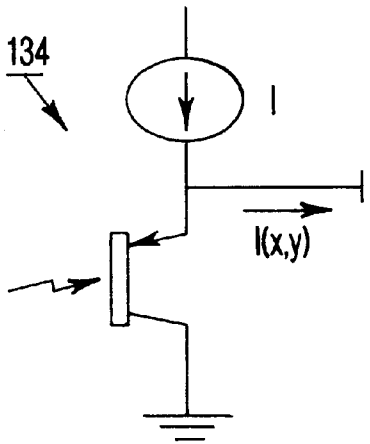
FIG. 10 is a schematic of a (a) basic cell of Poisson equation solver, (b) implementation of current source with MOS transistor and capacitance C3, (c) implementation of current source with photosensitive bipolar transistor.
Figure 10B:
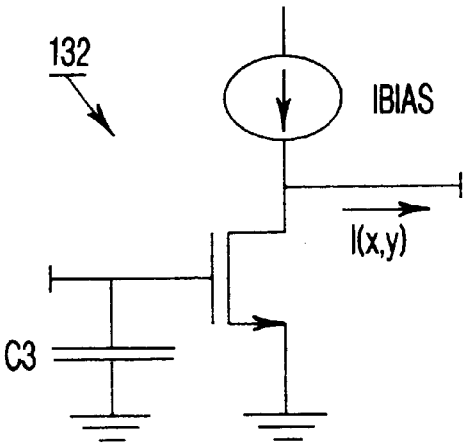
Figure 10A:
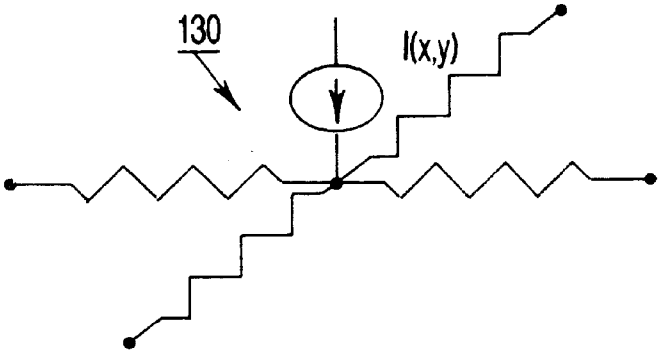

Poisson equation solver: The basic cell of a Poisson equation solver includes besides all elements indicated before a current source representing a local excitation 130 (see FIG. 10*a*). The current source is implemented with a transistor as shown in FIG. 10*b* 132 with a bipolar transistor or an MOS transistor. The value of the source is controlled by the gate-source (base-emitter) voltage of the transistor. This voltage is transferred externally through a bus and stored in a C3. For image processing applications the voltage can be provided directly (through appropriate optics) to each cell location by using a photosensitive device in each cell such as the base-emitter junction of a parasitic bipolar transistor 134 (FIG. 10*c*).

Figure 11C:
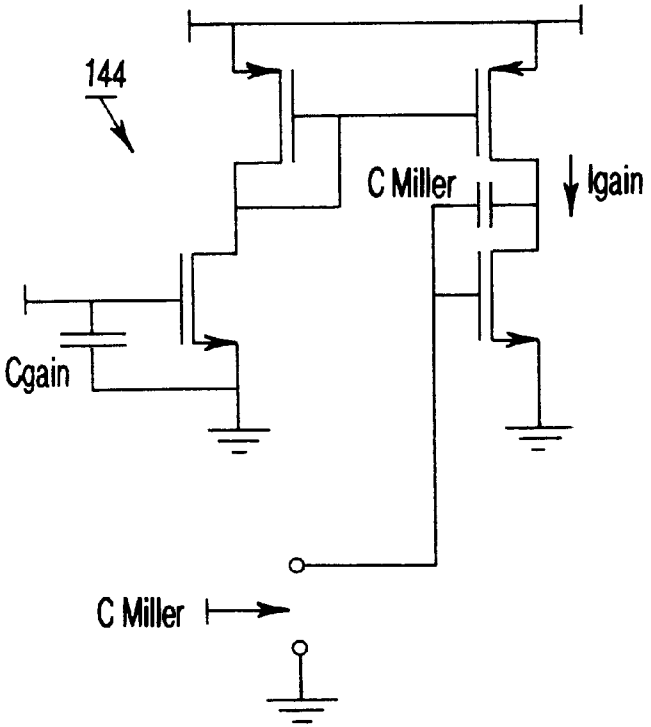
FIG. 11 is a schematic of a (a) basic cell of diffusion equation solver, (b) implementation of programmable capacitor C with a reverse biased PN junction, (c) implementation of Miller programmable capacitor with MOS gain stage.
Figure 11B:
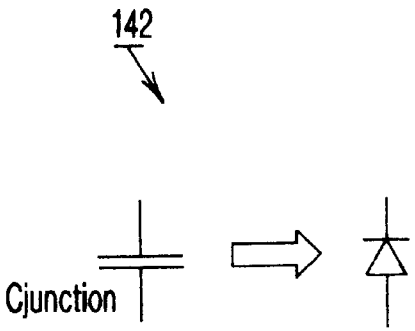
Figure 11A:
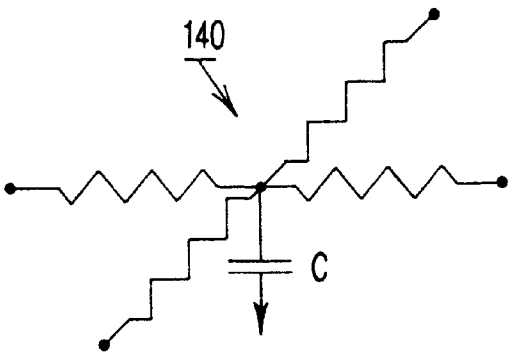

Diffusion equation solver: The basic cell 140 for a diffusion equation solver is shown in FIG. 11*a*. It has a capacitor C connected between the central cell node (VCELL) and ground. The implementation of a system of this type employs double poly or double metal capacitors for C if a fixed value is required, and if programmable (position dependent) values for C are required, there are several options to implement programmable capacitors, such as, the utilization of reverse biased PN-junction 142 capacitances (this can be programmed with the reverse bias voltage as shown in FIG. 11*b*), or the utilization of Miller capacitances 144 (connected between input and output of an adjustable gain stage) gain stage which can be programmed with the bias current of an MOS gain stage. The bias current can be programmed locally by storing a bias voltage to set this bias current in a capacitor Cgain (FIG. 11*c*). Since time behavior is a factor for diffusion problems the control circuitry of the chip has to be modified to freeze the voltages in the cells and samples their value in certain time intervals.

Figure 12C:
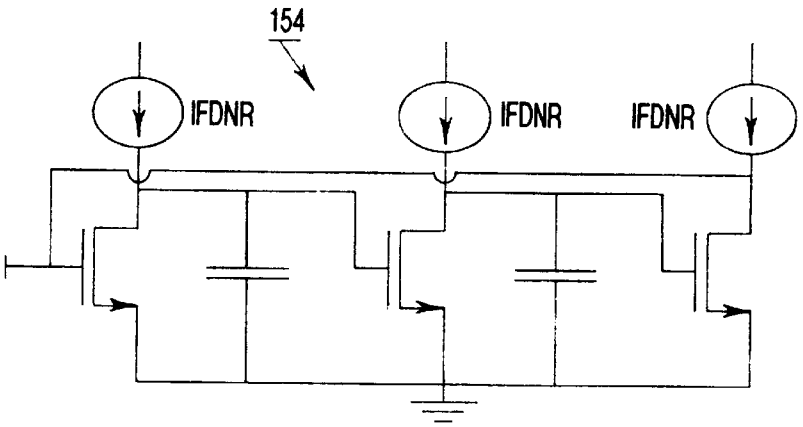
FIG. 12 is a schematic of a (a) basic cell of wave equation solver, (b) impedance transformed version of (a), (c) transistor level implementation of FDNR, (d) control of bias current IFDNR by means of voltage VFDNR.
Figure 12D:
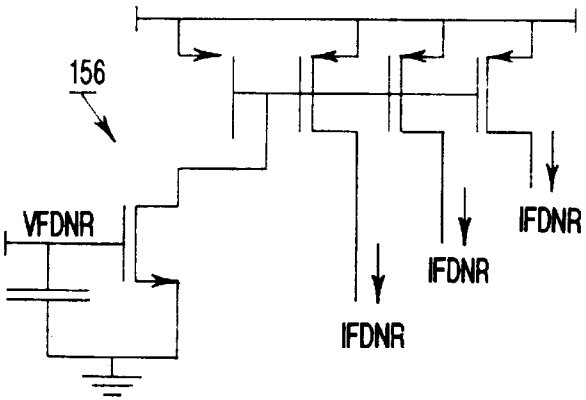
Figure 12A:
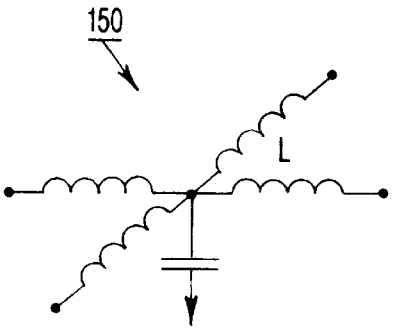
Figure 12B:
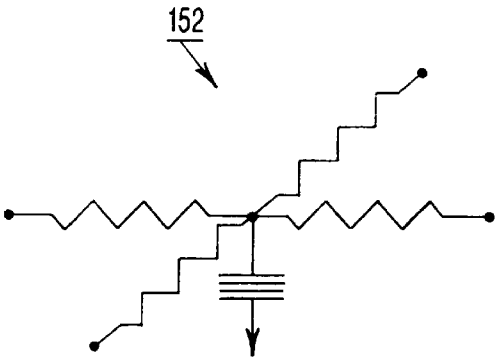

Wave equation solver: The basic cell 150 of a wave equation solver is shown in FIG. 12*a*. It has four inductors and one capacitor. The cell is impedance transformed by multiplying all its elements by the factor 1/s to a cell 152 including four resistors and an FDNR (or "supercapacitor"), as shown in FIG. 12*b*. The FDNR is an element having an impedance of the form Z=1/s2K. One transistor level implementation for an FDNR 154 is shown in FIG. 12*c*. It requires two capacitors and six transistors (each current source is implemented as a single MOS transistor in the saturated mode). The bias currents in the figure can be used to program the K value of the FDNR. The value of the bias currents can also be controlled by means of a voltage VFDNR 156 stored in a capacitor C4 as shown in FIG. 12*d*. This voltage can also be transferred externally to the cell.

General Cell Including Three Types of Elements

Figure 1:
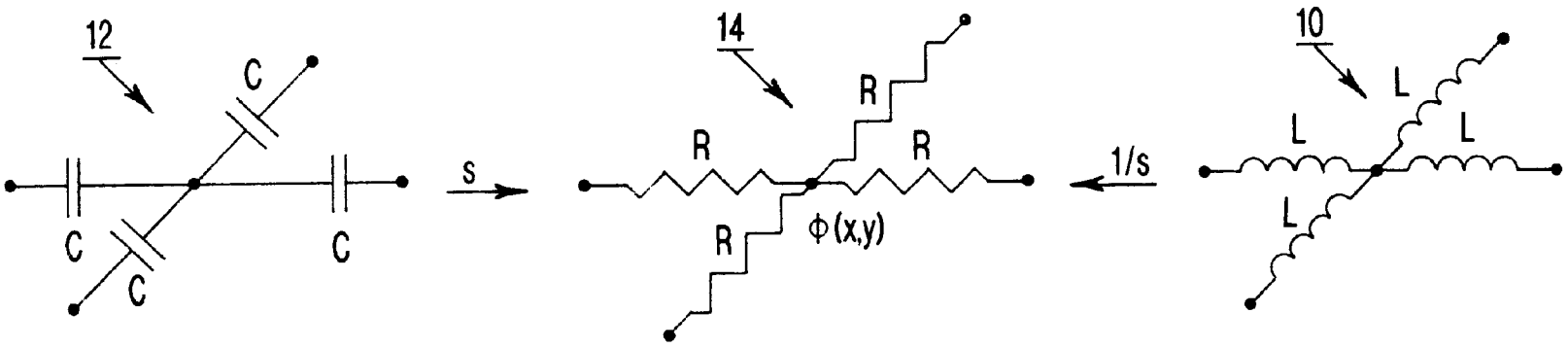
FIG. 1 is a schematic of a prior art resistive cell for solution of the Laplace equation in two dimensions.
Figure 2B:
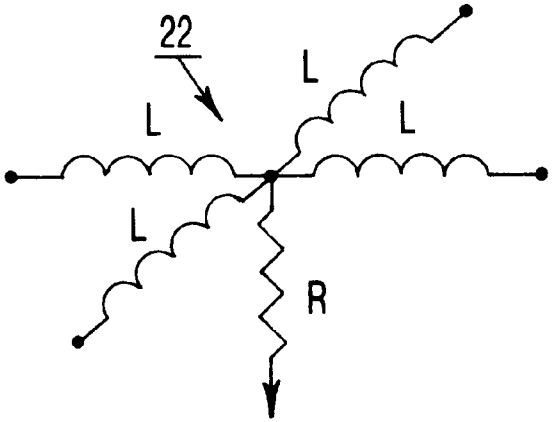
FIG. 2 is a schematic of prior art electrical equivalents of grid elements for the solution of the diffusion equation in two dimensions.
Figure 2A:
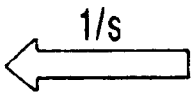
Figure 2A:
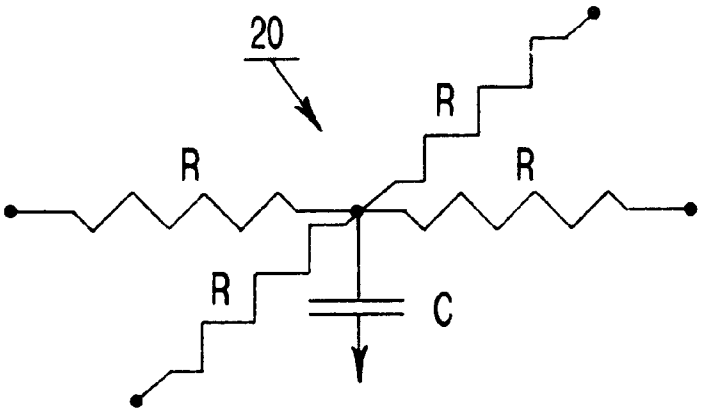
Figures 3A, 3B, 3C:
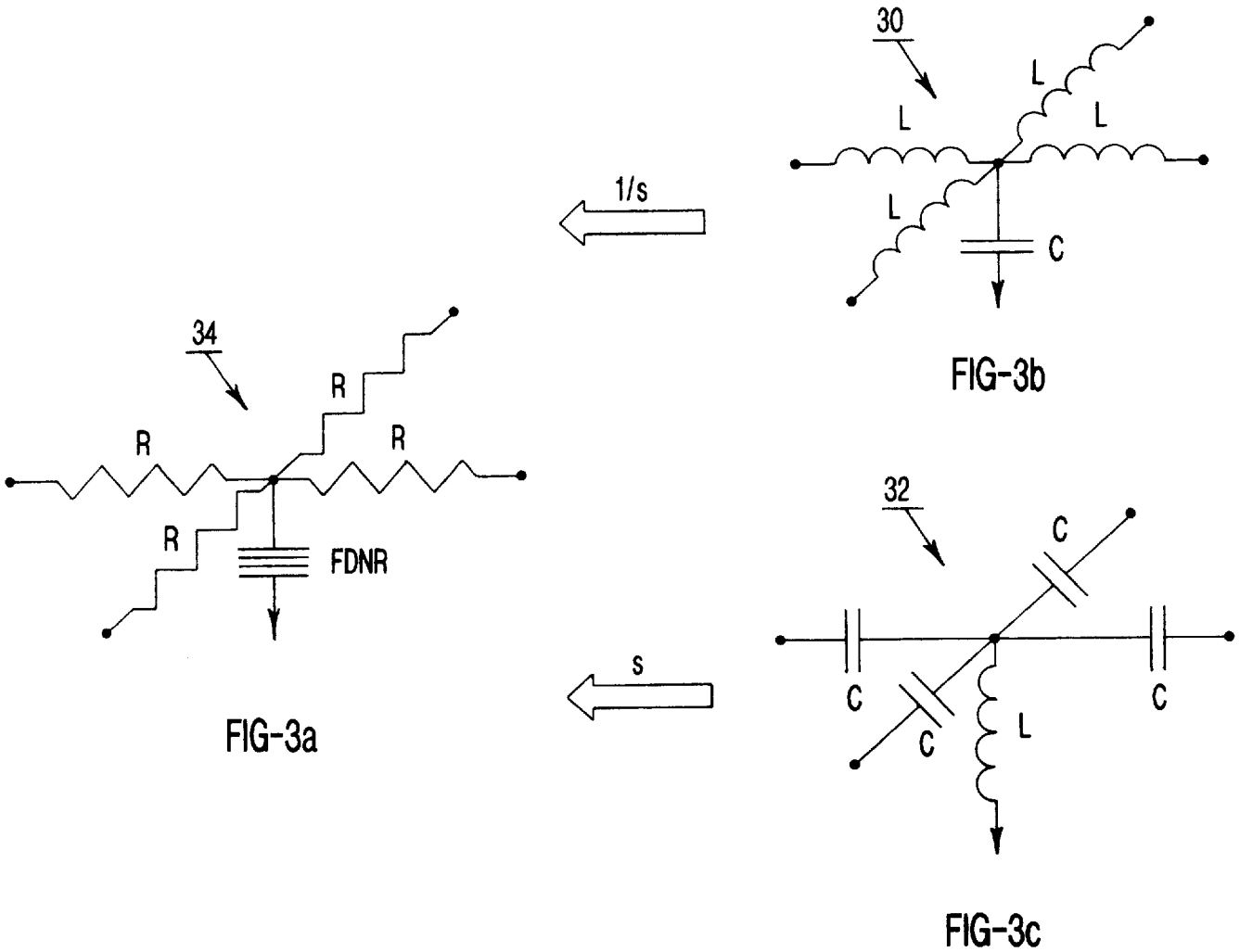
FIG. 3 is a schematic of prior art electrical equivalents of grid elements for the solution of the wave equation in two dimensions.
Figures 4A, 4B, 4C:
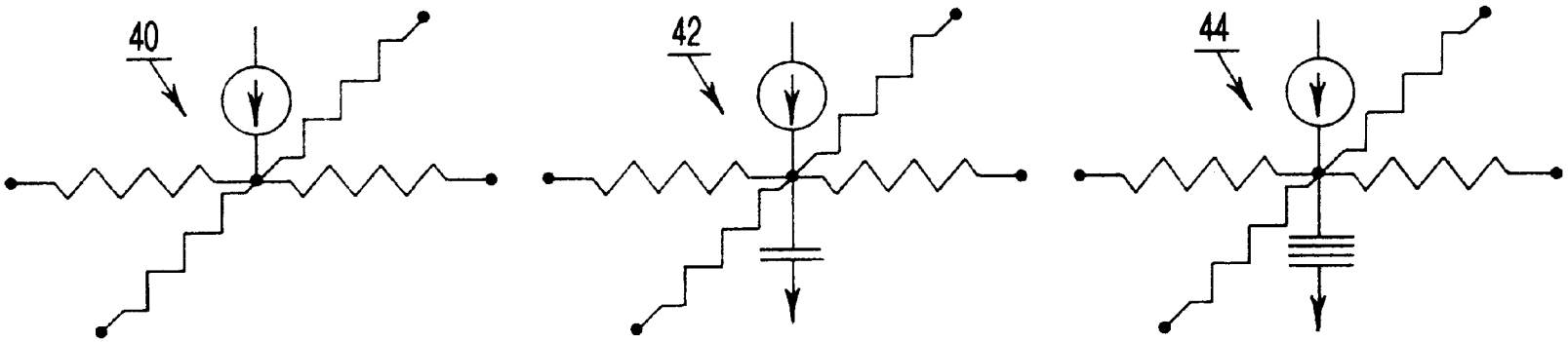
FIG. 4 is a schematic of prior art electrical equivalents of grid elements for the solution of the modified equations in two dimensions.
Figure 5B:
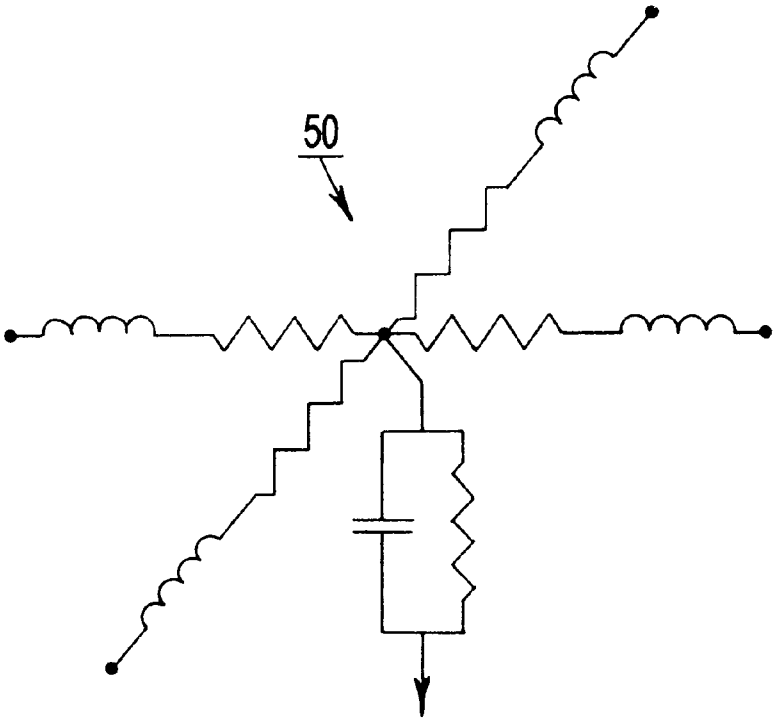
FIG. 5 is a schematic of prior art electrical equivalents of grid elements for the solution of the wave equation with damping in two dimensions.
Figure 5A:
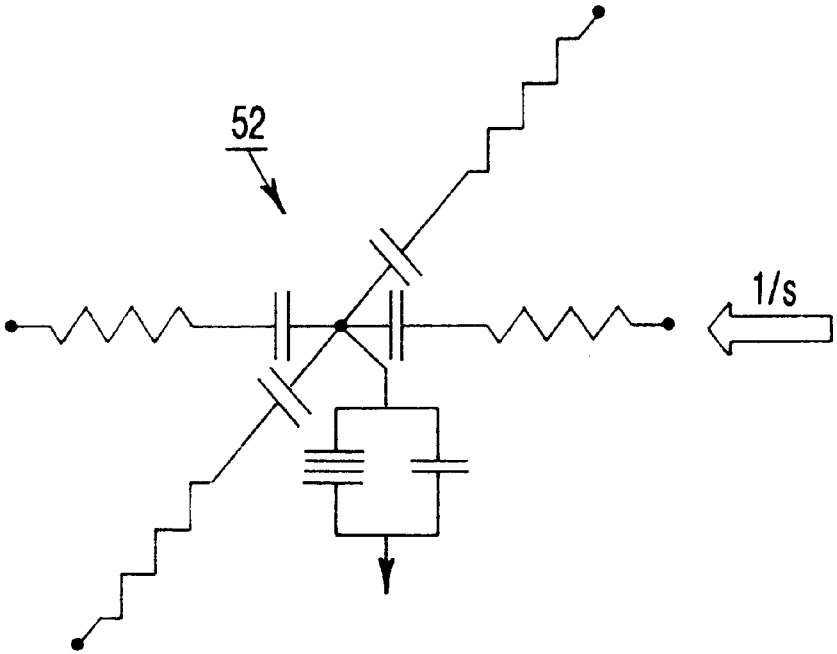
Figure 15:
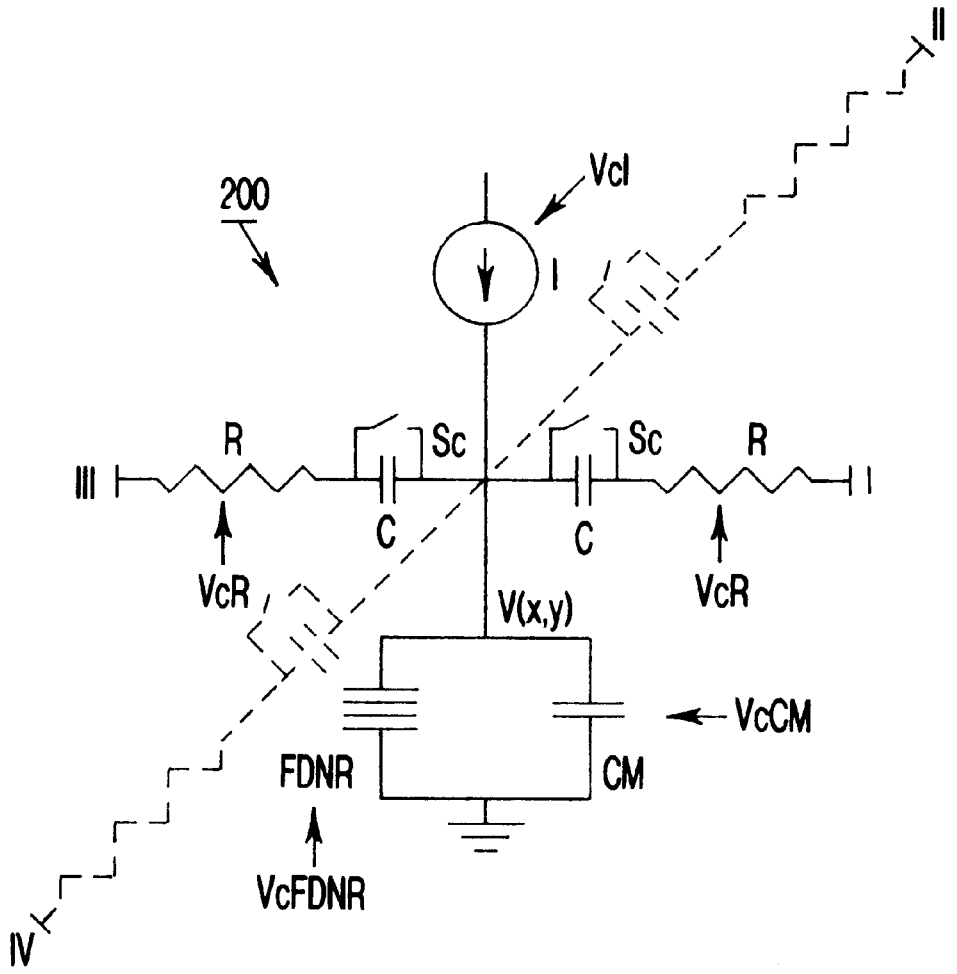
FIG. 15 is a schematic of the preferred elements of general cell for solution of seven specified equations.

FIG. 15 shows a general partial differential equation solver 200 that can be used to solve all partial differential equations addressed above. The basic cell of FIG. 5*a* is reconfigured using MOS switches and bias voltages to switch in and out elements to solve a specific type of differential equation. It includes resistors R (simulated by transistors in ohmic mode), fixed capacitors C (implemented as double, poly or double metal capacitors), a programmable Miller capacitor CM, an FDNR (supercapacitor implemented as indicated above), a current source I, and four CMOS switches which permit bypass of capacitors C when not required. Other elements are switched out using control bias voltages. For example, resistors are transformed into the equivalent of short circuits (i.e., bypassed) by applying a control voltage VcR that minimizes their equivalent resistances. Miller capacitors, FDNRs, and current sources are also passivated (switched out) by turning them off using their corresponding control voltages VcFDNR, VcCM, and VcI.

Cell With Binary Outputs

Figure 16:
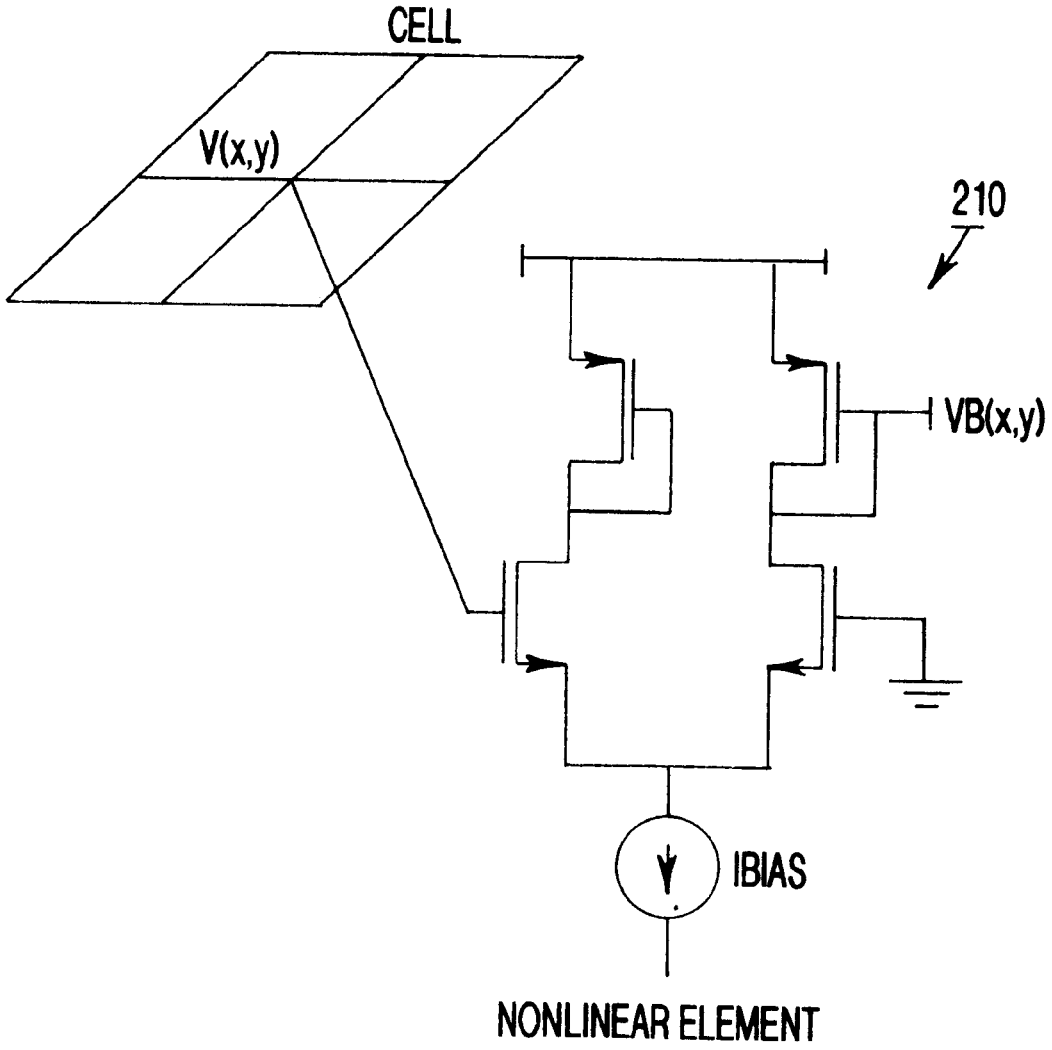
FIG. 16 is a schematic of the preferred elements of a nonlinear element with binary output.

Conventional neural networks and cellular neural networks include a nonlinear element that permits a binary output voltage which is then applied to other cells with which the cell interacts. This element usually implements a sigmoidal type of nonlinear function. In spite of the fact that the circuit addressed in the present invention is strictly linear, it is extensible to include a non-linear element (such as the simple amplifier 210 shown in FIG. 16) attached to the cell center node to obtain an additional binary output VB(x, y) which can be used to interact with other cells, permitting implementation of cellular neural networks, as well as other types of neural networks.

Advantages of the Invention

The most important feature that sets this approach for solving partial differential equations apart from traditional approaches based on the utilization of digital computers using the finite difference or the finite element methods is the speed of computation. The speed of the analog VLSI circuit is determined by the time constants of the circuit. The present invention will settle within a few microseconds. Another advantage of the given method is that the settling time is not strongly dependent on the size of the array. Computation speed is up to 5 orders of magnitude faster than what is obtainable with the fastest digital computers: a ten thousand node grid (100×100 cells) takes approximately 10 minutes to solve on a high-power main-frame computer, the same system can be solved by the present invention in a maximum of one millisecond offering a $10^5$ speed-up. The cost of the analog VLSI chip is a fraction of that of a digital computer. For practical purposes the speed of operation of the system is limited by the time required to write and read data from the cells. Due to its cellular nature, its configurability, its programmability, and its fault tolerance the present invention will find application in a wide variety of problems, such as image processing, computer vision, and general engineering and scientific computing.

EXAMPLES (INDUSTRIAL APPLICABILITY)

Below, two applications for the two-dimensional Laplace equation solver of the invention are addressed. One refers to the solution of electrostatic field distribution in laser trimmed film resistors, and the other to the application of the system as a cellular neural network implementing the so-called Gaussian operator, which is a well-known image processing operation. A board-level partial differential equation solver is also presented.

Example 1

Laser trimmed film resistors are used in high performance, high precision electronic systems. The calculation of field distributions is essential to determine hot spots which relate to the reliability of these elements and to calculate the amount of power dissipated at the edge of the laser cut, which is related to long term stability of the resistance. This long term stability limits the ultimate accuracy achievable with laser trimmed film resistors. The trimming operation causes the film resistor to acquire a nonhomogeneous resistivity so that field calculation becomes even more involved. Calculation of field distributions in film resistors using a high speed mainframe computer and a grid of 100 by 100 nodes with conventional numerical methods usually takes several minutes of digital CPU time. The Laplace equation solver of the invention can be used for this purpose. Through an appropriate interface (that can be integral part of the Laplace equation solver chip) a VLSI chip can solve these types of problems in less than one millisecond.

Figure 13B:
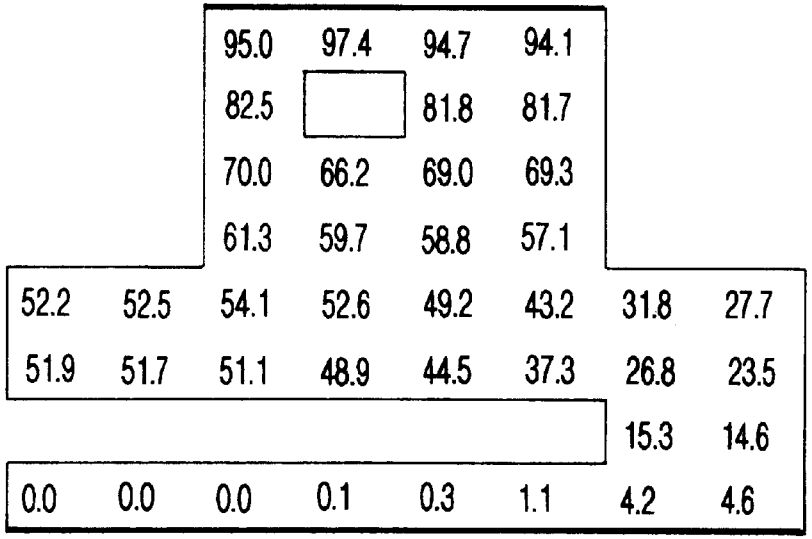
FIG. 13 illustrates for an exemplary laser trimmed film resistor (a) sheet resistance distribution (b) potential field distribution.
Figure 13A:
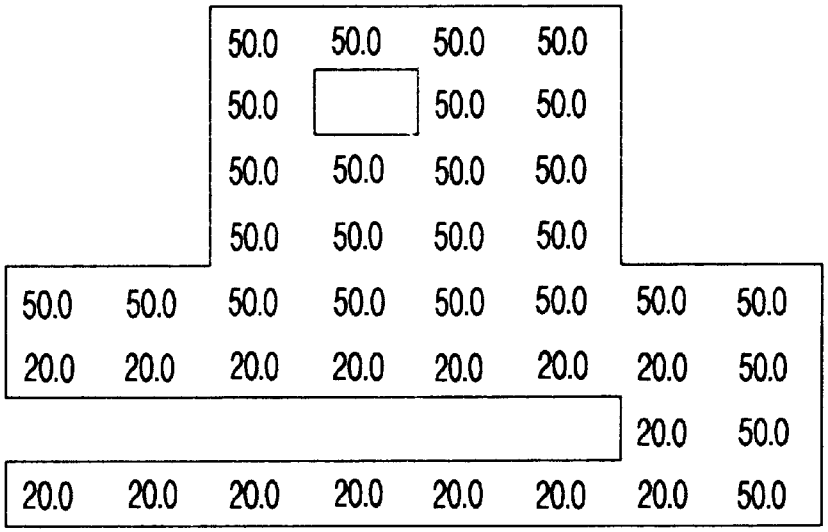

FIG. 13 illustrates graphically the numerical information of sheet resistance distribution (input data, FIG. 13*a*) and the calculated potential field distribution (output data scaled from 0 to 100, FIG. 13*b*) obtained through a conventional program for a simple example of a film resistor with nonhomogeneous resistivity (caused by the trimming operation). This identical information can be obtained from a Laplace equation solver chip.

Example 2

The Laplace chip can also be used for an image processing operation called Gaussian filtering by interfacing the chip directly to images. This can be done by including photosensitive elements (e.g. lateral bipolar transistor base-emitter junctions) in each cell. Each pixel of an image maps into one cell. The photosensitive element implements a current source whose value depends on the pixel value and which is injected to the center node of each cell 40. The network in this case implements a cellular neural network. Resistance values of the cell in this case correspond to the so-called Cloning templates. In the case of being equal within a cell and space invariant the values implement the so called Laplace operator. The equality and space invariance of the coefficients required by the Laplace operation allow tremendous simplification of the cell circuitry and reduction of the overall size of the VLSI system.

Cellular neural networks can implement a wide variety of image processing operations. This requires in general non-equal resistance values in each cell but space invariant (same for all cells) resistance values. With minor modifications and essential simplifications the present invention can be used to implement a generalized cellular neural network with fully programmable cloning templates. Such a system can implement a wide variety of image processing operations besides the Laplace operation addressed.

Example 3

Figure 14:
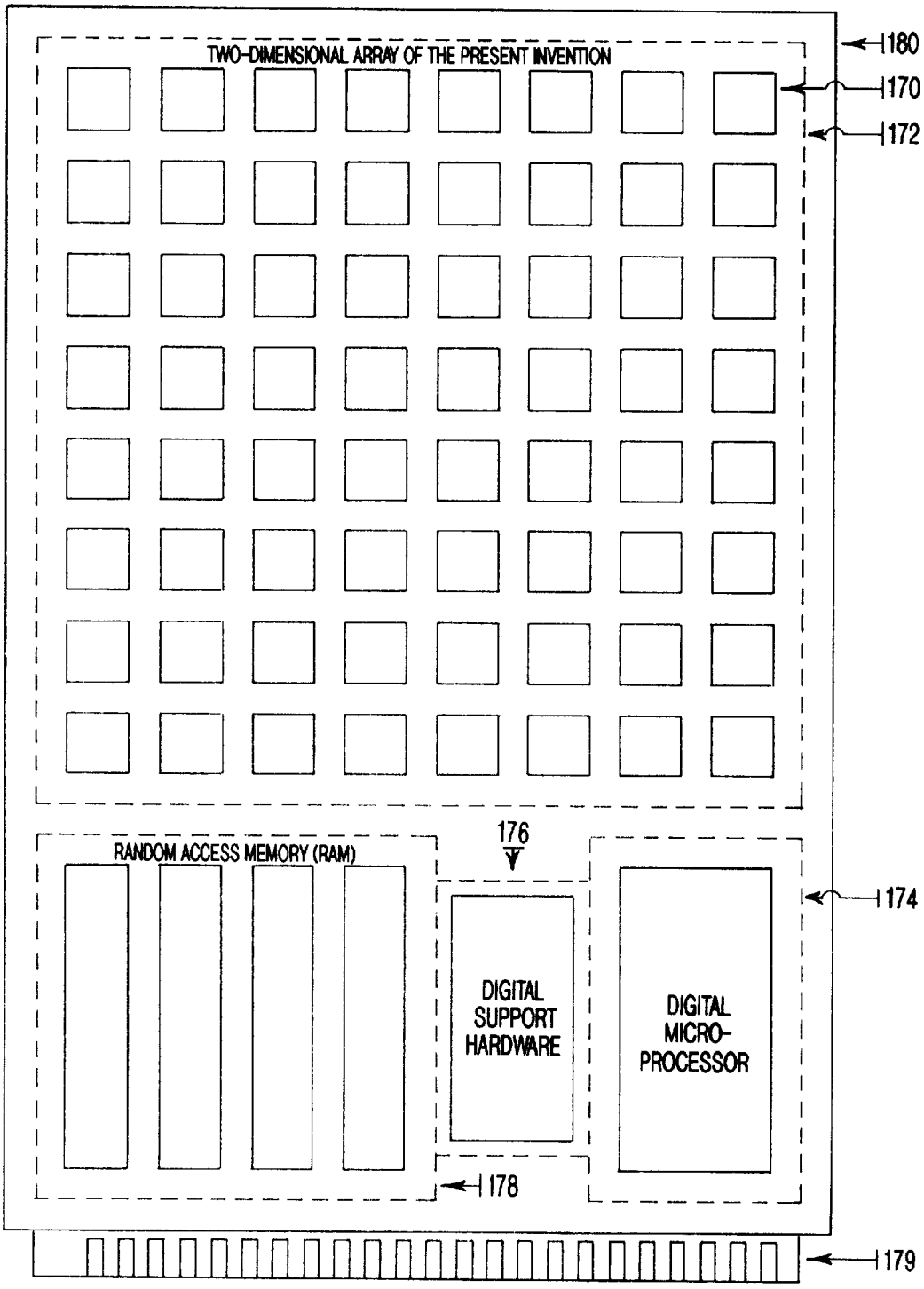
FIG. 14 is a block diagram of board-level partial differential equation solving system.

The present invention may be integrated into a board-level system 180 to enhance the performance of conventional digital processing systems. The system is capable of solving the seven types of equation discussed. The board level system, as shown in FIG. 14, consists of the following components:

A two-dimensional array 172 of the basic element of the present invention (with the enhancements for solving all seven basic types of partial differential equation) 170. This provides for the solution of extremely large equations (1024×1024 cells).

A dedicated digital microprocessor 174 and digital support hardware 176 for independent system operation. This allows the system to operate without requiring any computational support from the host system.

Internal random access memory (RAM) 178. This allows the system to operate without requiring host system RAM.

Socket connectors 179 for interfacing the board 180 with a host digital computer.

The host system will use the processing capabilities of the add-on partial differential equation solving system (PDESS) as a set of routines. Instructions and data are down-loaded from the host system to the PDESS. Once the down-load is complete the PDESS functions autonomously until the specified instructions are completed. When the processing is complete the PDESS interrupts the host system and provides the required simulation data or stores the results in the permanent memory of the host system. Multiple instruction and data sets may be down-loaded in one session, allowing for many tasks to be performed before the PDESS requires additional support from the host system.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. An apparatus for solving equations, the apparatus comprising:

means for receiving analog signals representative of an equation to be solved;

a multi-dimensional array of cells for processing said analog signals, each of said cells being individually programmable and being differently programmed one from another and having a resistance which is digitally configurable and comprising digitally configurable analog integrated circuit means and wherein the equations solvable by said apparatus comprises a partial differential equation selected from the group consisting of the Laplace equation, the diffusion equation, the wave equation, the Poisson equation, the modified diffusion equation, the modified wave equation, the wave equation with damping.

2. The apparatus of claim 1 wherein said apparatus solves the equations in real-time.

3. The apparatus of claim 1 wherein the equations solvable by said apparatus comprise non-linear partial differential equations.

4. The apparatus of claim 1 wherein the said cells comprise CMOS VLSI circuits.

5. The apparatus of claim 1 additionally comprising digital computer means for digitally configuring said analog integrated circuit means.

6. The apparatus of claim 1 wherein said digitally configurable analog circuit means comprises means for detecting and sending a cell potential.

7. The apparatus of claim 6 additionally comprising digital computer means for receiving said cell potential.

8. The apparatus of claim 1 wherein said multi-dimensional array of cells is a two-dimensional array of cells.

9. The apparatus of claim 8 wherein said multi-dimensional array of cells is a two-dimensional array of cells formed on a single VLSI chip.

10. The apparatus of claim 9 wherein said two-dimensional array of cells comprises an array of cells of at least 128 by 128 cells.

11. The apparatus of claim 1 wherein each of said cells is substantially identical of every other said cell.

12. An integrated circuit board for solving partial differential equations, the integrated circuit board comprising:

means for receiving analog signals representative of a partial differential equation to be solved;

an array of digitally configurable analog integrated circuit cells for processing said analog signals, each of said cells being individually programmable and being differently programmed one from another;

means for interfacing said circuit board to a data bus of a digital computer;

means for receiving digital configuration instructions form said data bus; and means for providing potentials of said cells to said data bus.

13. A method for solving equations, the method of comprising the steps of:

a) receiving analog signals representative of an equation to be solved;

b) providing a multi-dimensional array of digitally configurable cells for processing said analog signals to an analog integrated circuit board, each of the cells being individually programmable and being differently programmed one from another;

c) digitally configuring a resistance of each of the cells; and wherein the equations solvable by the method comprises a partial differential equation selected from the group consisting of the Laplace equation, the diffusion equation, the wave equation, the Poisson equation, the modified diffusion equation, the modified wave equation, the wave equation with damping.

14. The method of claim 13 additionally comprising the step of solving the equations in real-time.

15. The method of claim 13 wherein the equations solvable by the method comprise non-linear partial differential equations.

16. The method of claim 13 wherein the providing step comprises providing cells implemented in CMOS VLSI.

17. The method of claim 13 additionally comprising the step of digitally configuring one or more cells buy digital computer.

18. The method of claim 13 additionally comprising the step of detecting and sending a cell potential.

19. The method of claim 18 additionally comprising the step of receiving the cell potential by digital computer.

20. The method of claim 13 wherein the providing step comprises providing a two-dimensional array of cells.

21. The method of claim 20 wherein the providing step comprises providing a two-dimensional array of cells to a single VLSI chip.

22. The method of claim 21 wherein the providing step comprises providing a two dimensional array of cells of a least 128 by 128 cells.

23. The method of claim 13 wherein the providing step comprises providing cells which are substantially identical to one another.

24. A method for solving partial differential equations, the method comprising the steps of:

a) receiving analog signals representative of a partial differential equation to be solved;

b) providing an array of digitally configurable analog signals to an integrated circuit board, each of the cells being individually programmable and being differently programmed one from another;

c) interfacing the circuit board to an data bus of a digital computer;

d) receiving digital configuration instructions from the data bus; and e) providing potentials of he cells to the data bus.

* * * * *

UNITED STATES PATENT AND TRADEMARK OFFICE

CERTIFICATE OF CORRECTION

PATENT NO. : 6,141,676 
DATED : October 31, 2000
INVENTOR(S) : Jaime Ramirez-Angulo and Mark R. DeYong It is certified that error appears in the above-identified patent and that said Letters Patent is hereby corrected as shown below:

Column 16,
Line 64, delete “buy” and insert therefor -- by --.

Column 17,
Line 15, delete “he” and insert therefor -- the --

Signed and Sealed this

First Day of June, 2004

JON W. DUDAS
*Acting Director of the United States Patent and Trademark Office*